US006715329B1

(12) United States Patent
Hametner

(10) Patent No.: US 6,715,329 B1
(45) Date of Patent: Apr. 6, 2004

(54) METHOD AND DEVICE FOR FORMING A CORNER LIMITED ON THREE SIDES, FROM A PLATE-SHAPED MATERIAL WITH AN EVEN SURFACE

(75) Inventor: Markus Hametner, Asten (AT)

(73) Assignee: "ACF" Engineering & Automation GmbH, Steyr (AT)

( * ) Notice: Subject to any disclaimer, the term of this patent is extended or adjusted under 35 U.S.C. 154(b) by 0 days.

(21) Appl. No.: 09/979,590

(22) PCT Filed: May 16, 2000

(86) PCT No.: PCT/AT00/00133

§ 371 (c)(1),
(2), (4) Date: Feb. 26, 2002

(87) PCT Pub. No.: WO00/69726

PCT Pub. Date: Nov. 23, 2000

(30) Foreign Application Priority Data

May 17, 1999 (JP) ..... 11-135224
Jan. 26, 2000 (AT) ..... 113/2000

(51) Int. Cl.[7] ..... B21D 7/22
(52) U.S. Cl. ..... 72/220; 72/379.2
(58) Field of Search ..... 72/220, 379.2, 72/214, 210, 212, 322

(56) References Cited

U.S. PATENT DOCUMENTS 45,226 A * 11/1864 Chambers ..... 72/220
48,516 A * 7/1865 Chambers ..... 72/220
5,943,899 A * 8/1999 Jung ..... 72/379.2
6,047,585 A * 4/2000 Haslinger ..... 72/214

FOREIGN PATENT DOCUMENTS

| | | |
|---|---|---|
| DE | 40 09 466 | 9/1991 |
| DE | 195 32 963 | 3/1997 |
| DE | 196 14 517 | 10/1997 |
| JP | 07 204752 | 8/1995 |
| JP | 10 193010 | 7/1998 |

* cited by examiner

*Primary Examiner*—Allen Ostrager
*Assistant Examiner*—John S Goetz
(74) *Attorney, Agent, or Firm*—Collard & Roe, P.C.

(57) ABSTRACT

The invention relates to a method and a device for forming a corner bounded on three sides from a flat plate part, in particular sheet metal, whereby the side edges adjacent to the corner are folded back across a major part of their longitudinal extension parallel with the flat plate part and shaped on a curved path in the region in which the corner is to be formed from the folded-back side edge to the plane of the flat plate part. The pre-formed blank is then pressed at the curved transition region by means of at least one roller system (42), spanning the corner region (10) between the side edges, against a tool (16) and the corner shaped by forming the material and optionally trimmed in a cutting device.

14 Claims, 15 Drawing Sheets

METHOD AND DEVICE FOR FORMING A CORNER LIMITED ON THREE SIDES, FROM A PLATE-SHAPED MATERIAL WITH AN EVEN SURFACE

Applicant claims priority under 35 U.S.C. §119 of Japanese Application No. 11-135224, filed May 17, 1999 and Austrian Application No. A113/2000 filed Jan. 26, 2000. Applicant also claims priority under 35 U.S.C. §365 of PCT/AT00/00133 filed May 16, 2000. The international application under PCT article 21(2) was not published in English.

The invention relates to a method of forming a corner region from a flat sheet, in particular sheet metal plate, and a system for producing a corner region on a component from a flat sheet, bounded on three sides.

By preference, it relates to a corner-forming device adapted by means of an adjusting mechanism to handle a box-type component whereby the adjusting mechanism is used to adjust at least one of either the tool or a roller system to a forward or retracted position in order to adjust the tool exactly to the thickness of the box-type component, thereby obtaining a high degree of accuracy in the dimensions of the corner region of the box-type component.

In housings used to receive electronic instruments, communication devices, circuit boards and similar, the housing is made from a flat piece of plate or a sheet. This type of housing has an opening in the main body and a cover which can be placed on the opening. The cover is designed for opening and closing. The cover is a box-shaped component made from a sheet, which is made by a plate forming process.

If a cover or similar is to be provided on the metal housing, it is made starting from a sheet, which is shaped into a box-shaped component. To this end, rectangular/square cut-outs are made in the four corners of a rectangular standard flat sheet metal plate. The plate is then folded along the four side edges in order to form the four side walls. The corresponding end parts of the oppositely lying side walls are then welded together in order to form a corner region. These corner regions are finished by means of a polishing machine, etc.

Known methods of producing box-shaped components require the following work steps: cutting the parts of material out of the four corners of the plate; folding the plate along the four side edges to form the side walls; welding together the corresponding end parts of adjacent side walls to form a corner region and finishing the corner region with a polishing machine or similar.

These corner regions are therefore formed to produce box-type components by a series of shaping processes of this type. This approach is unacceptable from various points of view because such a large number of work steps complicates the process of making the corner regions of such box-type components and thus increases costs.

Documents DE 40 09 466 C2 and DE 196 14 517 A disclose a corner-forming machine and a method of producing box-type components. With this device, a roll is used as a bending tool for shaping and profiling corners starting from a plate-shaped workpiece, in order to form a planar surface into a corner bounded on three sides. The workpiece is held down on the tool by means of an essentially rectangular-shaped clamp. Fixed in this manner, the plate-shaped workpiece is then shaped using a tool in the form of a roller with an hour glass shape. The clamp and the tool are displaced relative to one another in the plane in which the sheet to be formed is held. This means that the vertical side faces of the plate to be formed project beyond the parallel side faces of the clamp, including when the latter is moved into its sheet-clamping position in readiness for shaping. Using the clamp, coverage of the corner region is provided by the clamp but the material in this region is prevented from being stretched which can lead to tearing in the corner region, which is unacceptable both from an aesthetic point of view and for safety reasons.

Accordingly, DE 196 14 517 A proposed that the oppositely lying vertical side faces of the tool and the clamp should be displaced relative to one another by a horizontal distance and that the face of the clamp should also be inclined. The disadvantage of this approach is that the component is not held firmly between the roll used to shape the component and the clamp and therefore gives in this direction during the rolling process, which leads to warping in the region of the flat sheet-part of the box-type component.

The underlying objective of the present invention is to propose a method of producing corners in box-type components made from flat plates, which enables corner regions for box-type components to be made in a wide variety of external dimensions and thicknesses whilst causing as few problems as possible in terms of finishing, and a system for producing such box-shaped components, by means of which corner regions of different designs can be produced from flat plates at the peripheral region of pre-formed sheet-parts.

This objective is achieved by the invention, independently in each case, by means of the methods described in claims 1 to 4 and 26 and the systems described in claims 28 to 33.

The method described in claim 1 is of advantage because the side walls are guided across the entire height of the tool and lie against its vertical shaping surfaces so that the component can be raised unhindered in a perpendicular direction towards the top face of the tool even if projecting areas have not yet been removed.

The method outlined in claim 2 has the advantage of enabling the projecting region between the side edges of the side walls of the component to be cut off in the corner regions without burring. Due to the fact that the cutting elements can be displaced relative to one another in the same plane as the guide surface, any misalignment in the two side walls forming the corner region can be compensated in the upward direction as the projecting area is cut off, even if tolerances arise as a result of folding when making the side walls.

The advantage of the approach described in claim 3 is that no cambering can occur between the side walls and the flat sheet part of the component as the corner region of the side walls is shaped.

The advantage afforded by the features outlined in claim 4 is that the relative position of the shaping surfaces of the tool can be adjusted and adapted exactly to the cylinder contours of the roller system and its roll, advantageously preventing any indentation or undesirable material deformations in the corner region of the component surface and the shaping region of the roller system or roll because the entire shaping process takes place across the entire forming path.

Claims 5 to 25 describe advantageous features which enable high quality components to be produced.

The process sequence described in claim 26 produces a high surface quality without warping or any undesirable wave-type deformation in the corner region of the material.

The process sequence described in claim 27 ensures that the transition region of the side walls is not misaligned in the corner region.

A system design as described in claim 28 offers an advantage because it prevents the projecting area from being deformed below the bottom face of the tool.

Claim 29 provides an advantageous arrangement in which the cutting elements exactly adjoin the actual contour of the side edges and can be adapted to projections in the transition region without having to be manually re-positioned.

The solution offered in claim 30 advantageously ensures that the plate-shaped sheet part of the component stays flat.

As a result of the arrangement outlined in claim 31, surface roughening due to too high friction forces on the component is significantly reduced or totally avoided whilst the cooling process and lubricating process also enable higher throughput rates.

With the embodiment defined in claim 32, the shape of the cylinder contour or geometry of the roll in the roller system can be accurately adapted to different shapes of corner regions. A roller system incorporating the tools needed to impart the respective shape to the corner region can be held in readiness and it, as well as the tool, can be adapted with little manual handling by adjusting the corner regions.

An arrangement of the type described in claim 33 enables the absolute minimum in tolerance limits to be obtained in the shaping and transition region when forming the corner region, thereby obviating the need for cost-intensive finishing.

Other advantageous embodiments are described in claims 34 to 37, which make for cost-effective and hence economic plant and equipment for producing components.

Claim 38 describes an advantageous embodiment as a result of which a very compact and space-saving unit can be obtained, offering considerable simplifications in the control unit for implementing the shaping process and safety control to protect operating personnel.

Another possible embodiment is described in claim 39, whereby the roll used to shape the corner region can be rapidly changed so that the shaping device can be adapted to suit different shaping specifications, e.g. corner radius, etc..

Finally, the embodiment defined in claim 40 is of advantage since it enables very high clamping forces to be applied and thus produces accurate shaping.

The invention will be described in more detail with reference to examples of embodiments illustrated in the appended drawings.

Of these:

Figure 21:
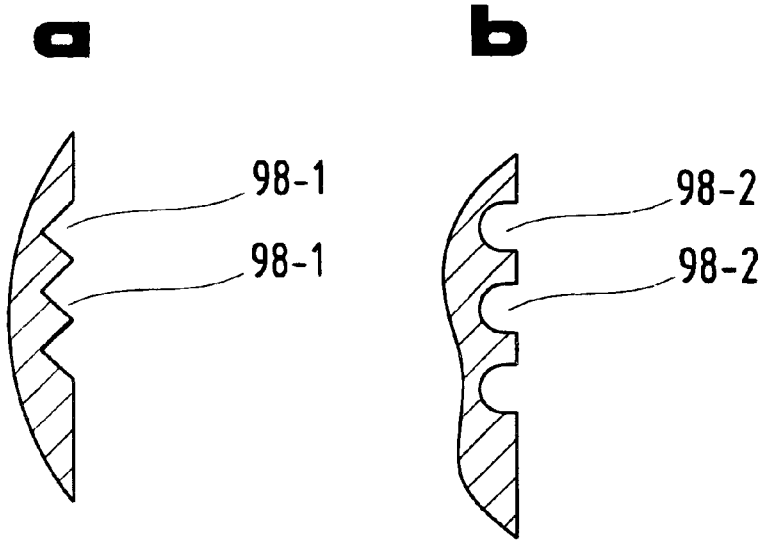
Figure 22:
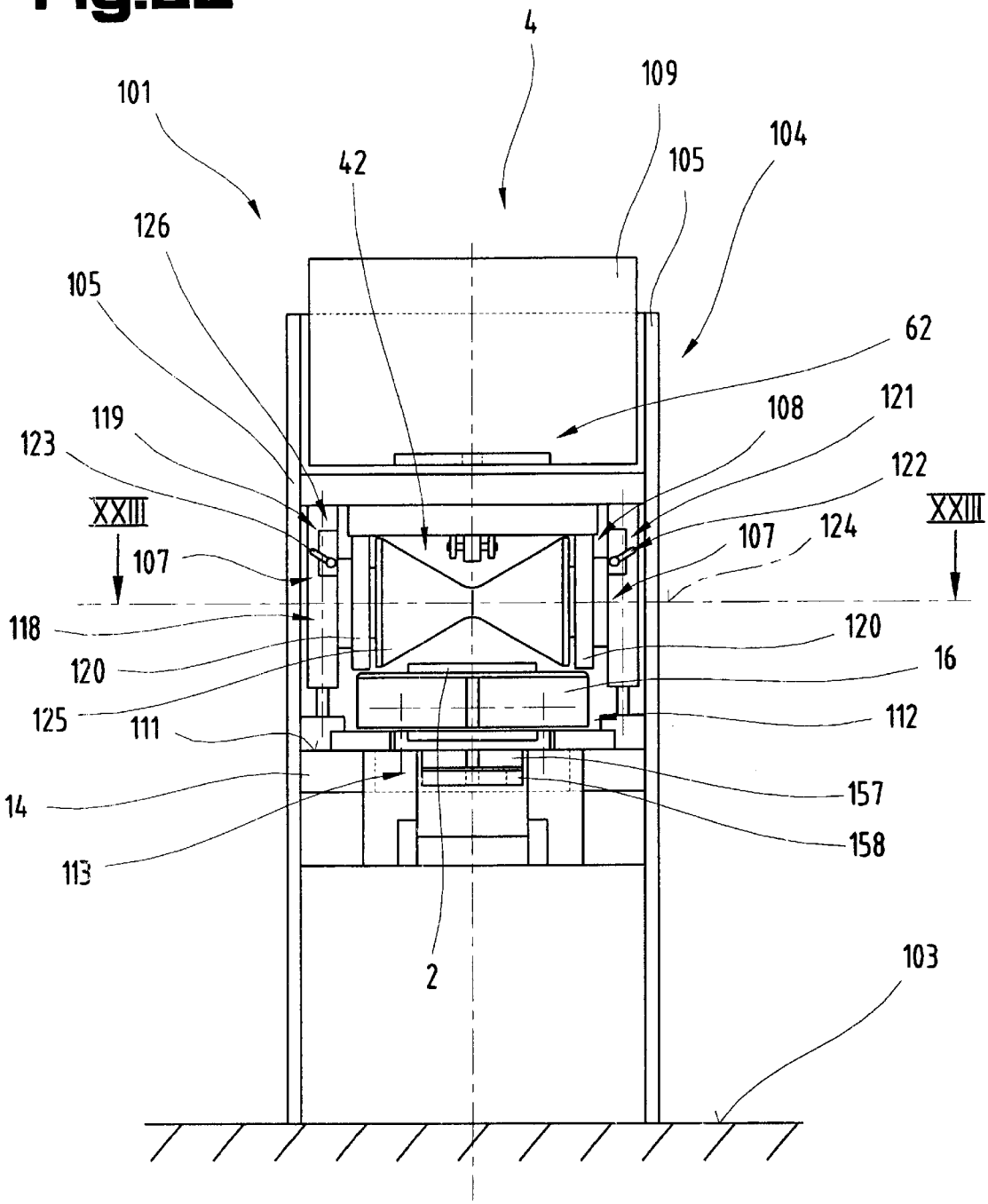
Figure 23:
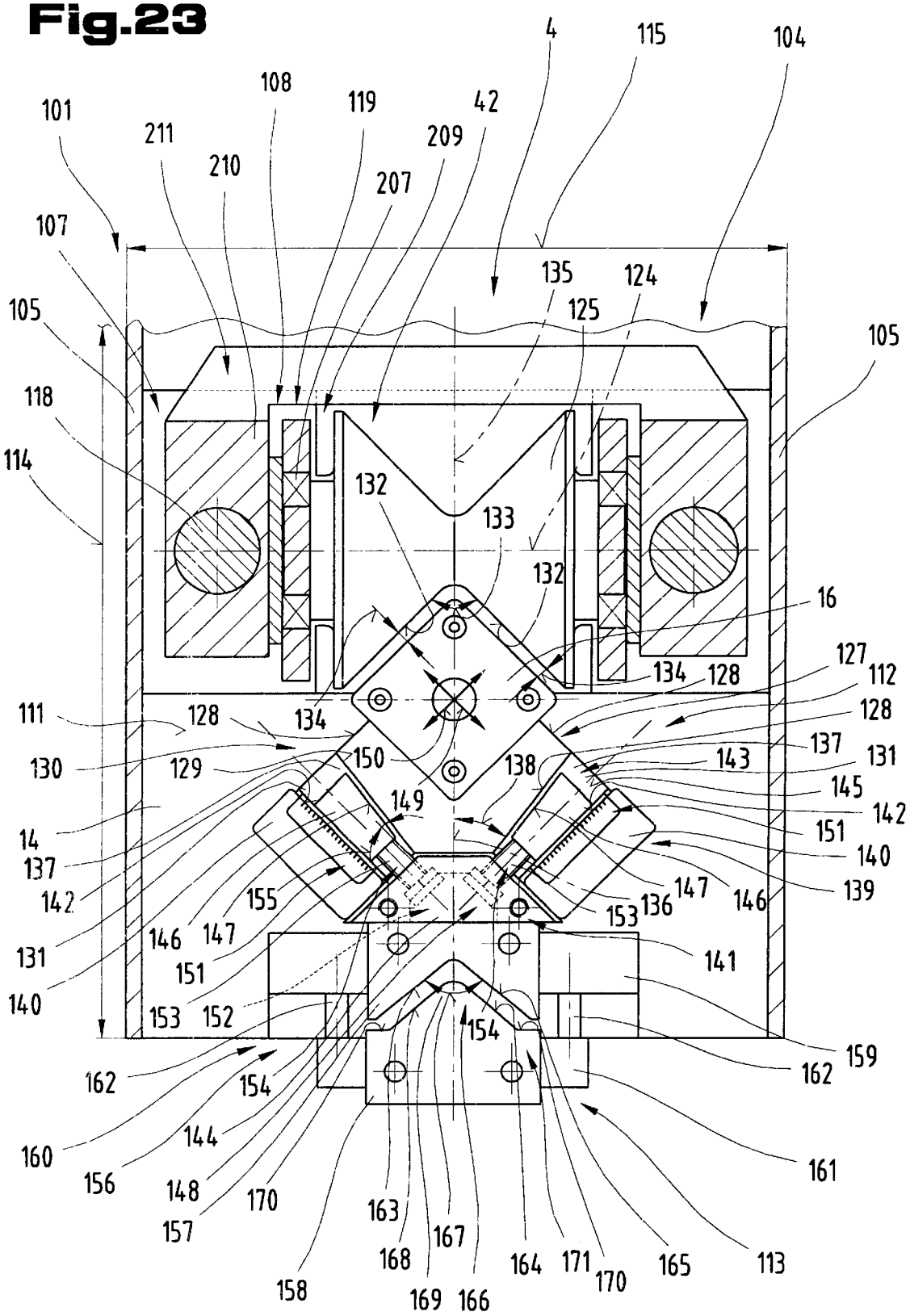
Figure 24:
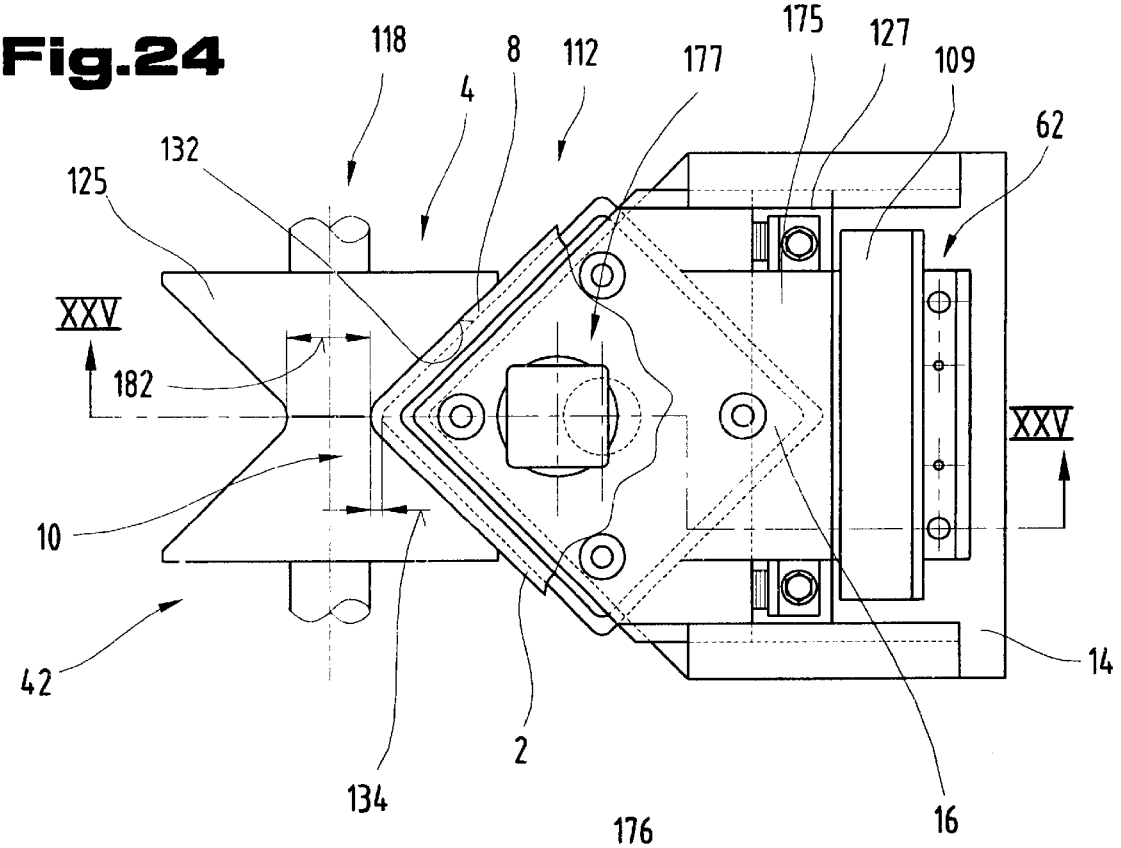
Figure 25:
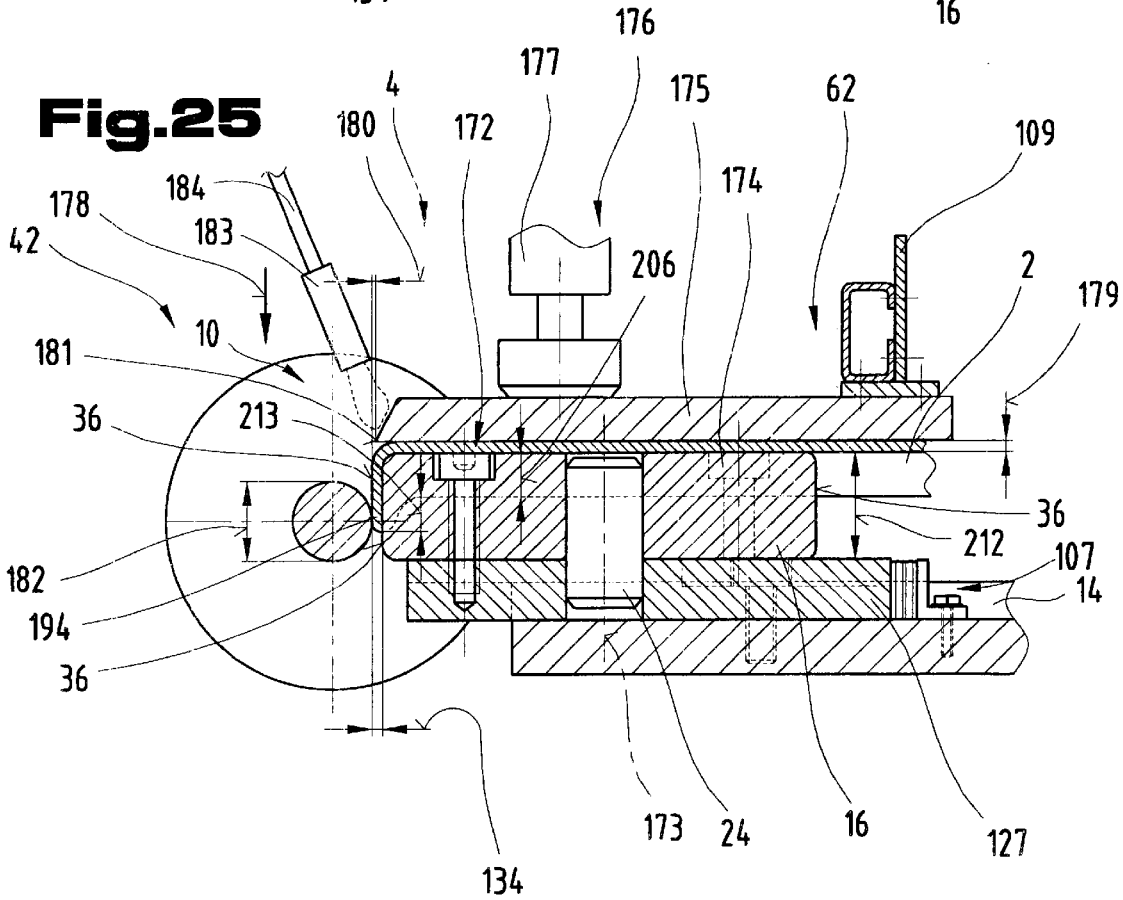
Figure 26:
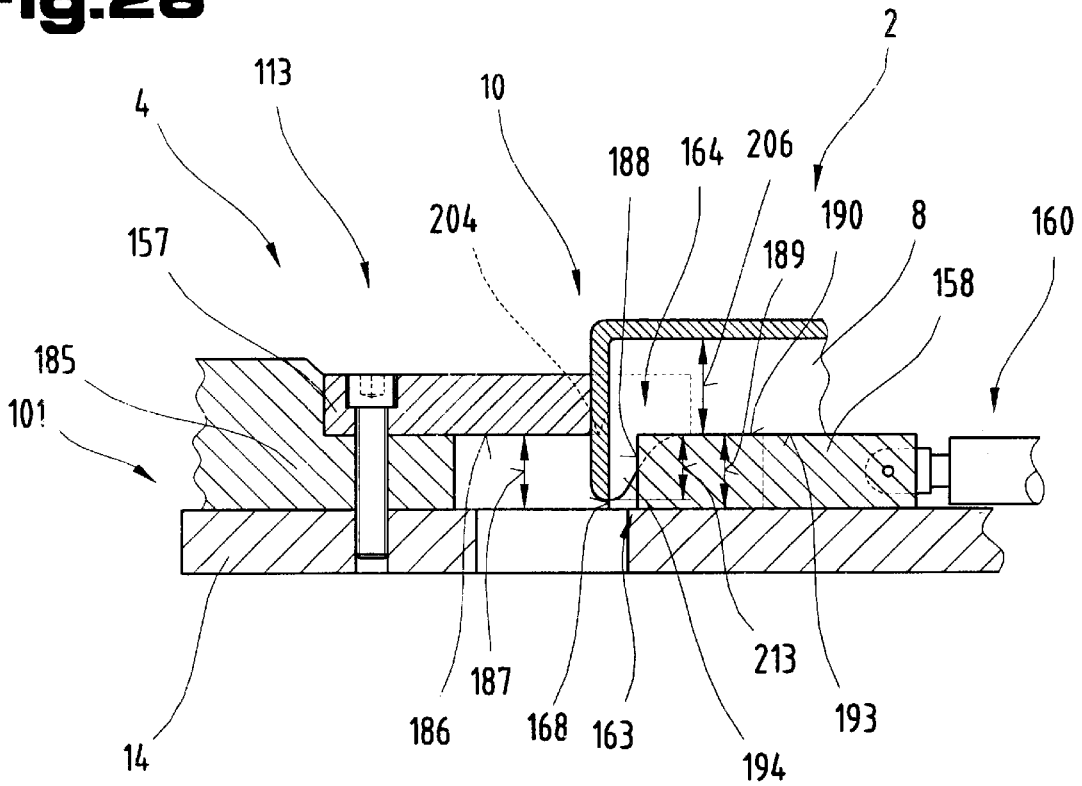
Figure 27:
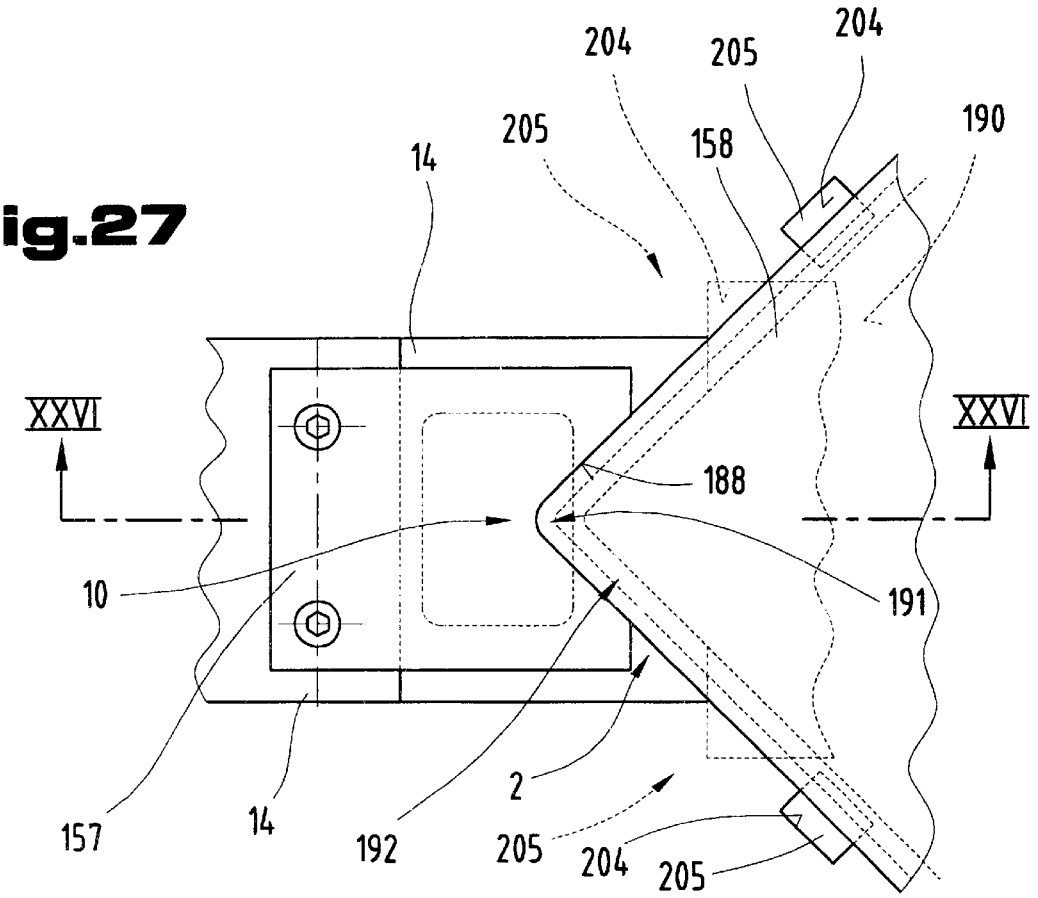
Figure 28:
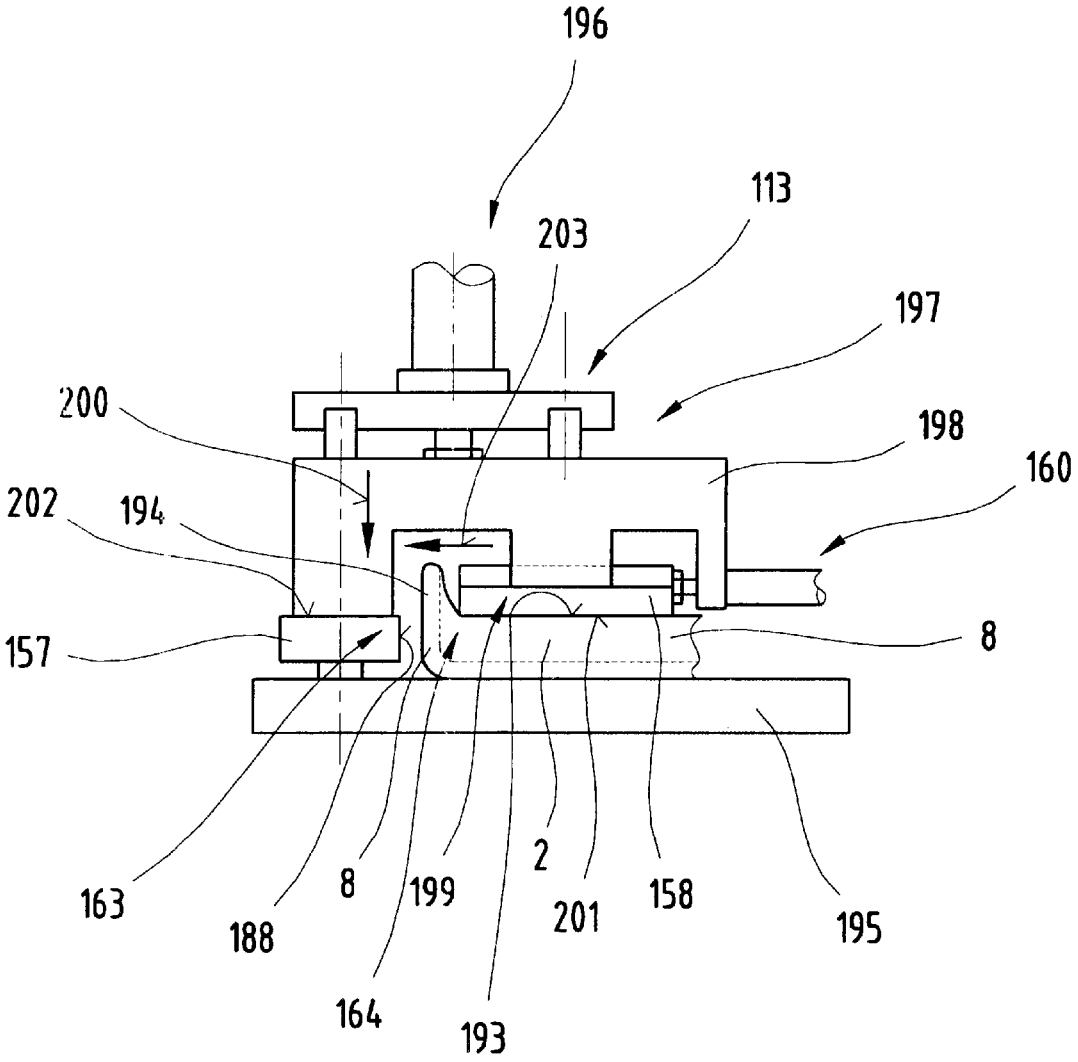
Figure 29:
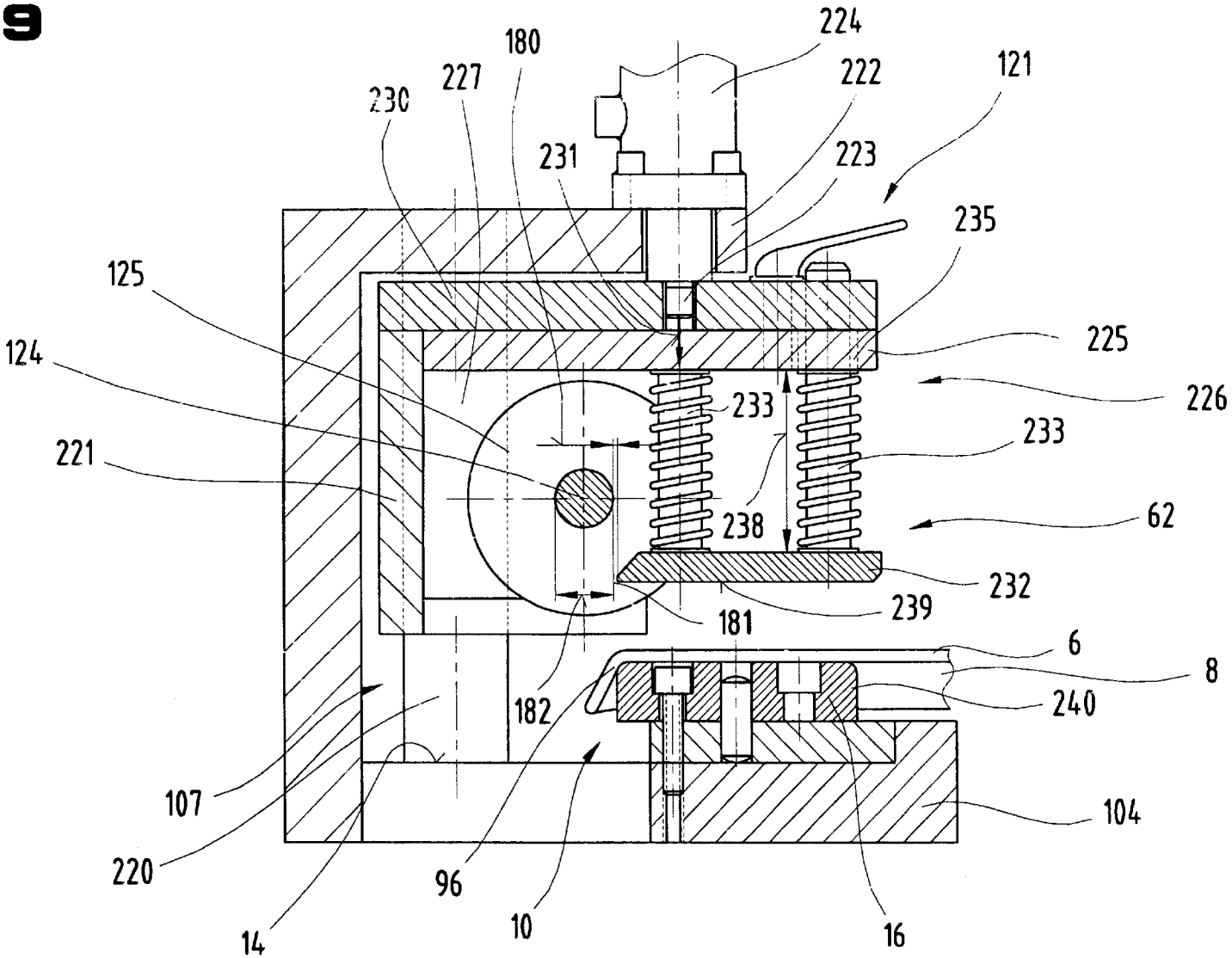

FIG. 21*a* is a schematic illustration, in section, of a grooved region of the tool;

FIG. 21*b* is a schematic illustration, in section, of a grooved region of the tool;

FIG. 22 is a front view of another embodiment of the corner-shaping device;

FIG. 23 shows a plan view of the corner-shaping device illustrated in FIG. 22, seen in partial section;

FIG. 24 is a detailed illustration, in plan view, of the corner-shaping device;

FIG. 25 shows the corner-shaping device, seen in section along the lines XXV—XXV of FIG. 24;

FIG. 26 shows another embodiment of the cutting device proposed by the invention, seen in section along the lines XXVI—XXVI of FIG. 27;

FIG. 27 is a schematic illustration of the cutting device illustrated in FIG. 26, seen in plan view;

FIG. 28 is another schematic diagram depicting another embodiment of the cutting device proposed by the invention;

FIG. 29 shows another embodiment of the roller system with the clamping device of the corner-shaping device proposed by the invention, seen in section.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIGS. 1 to 15 illustrate an embodiment of the present invention.

Figure 2:
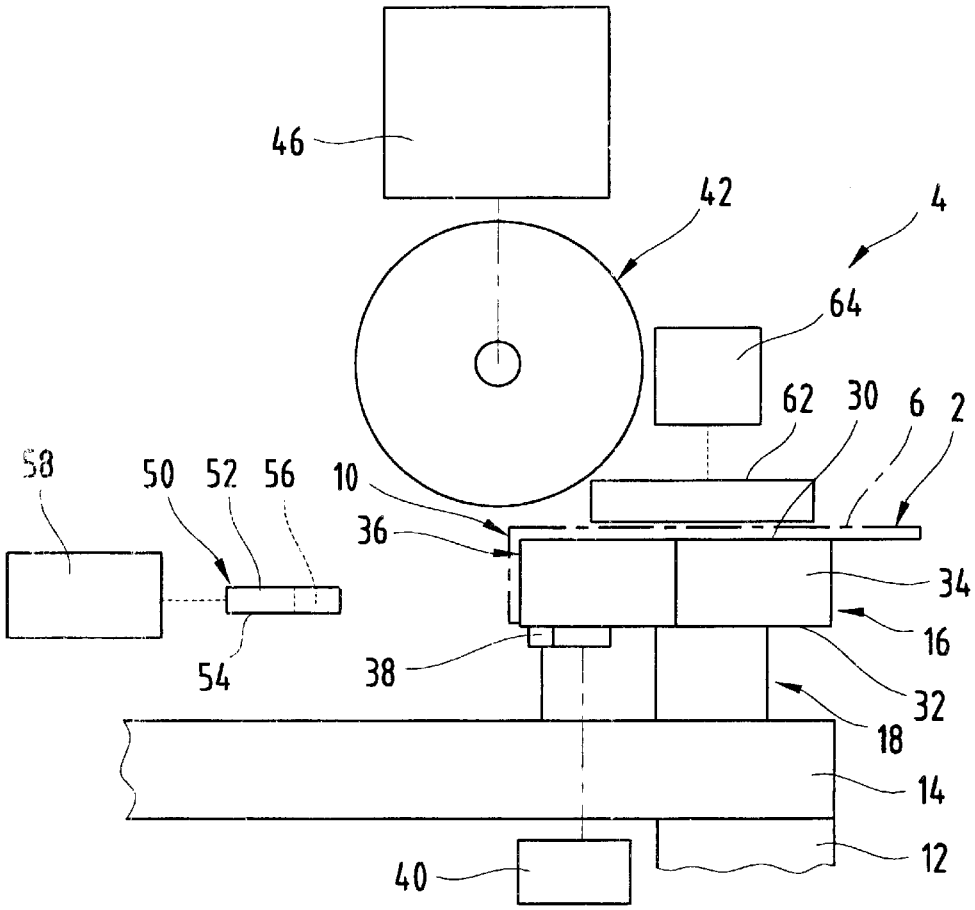
FIG. 2 is a side view of a main part of the corner-shaping device.
Figure 3:
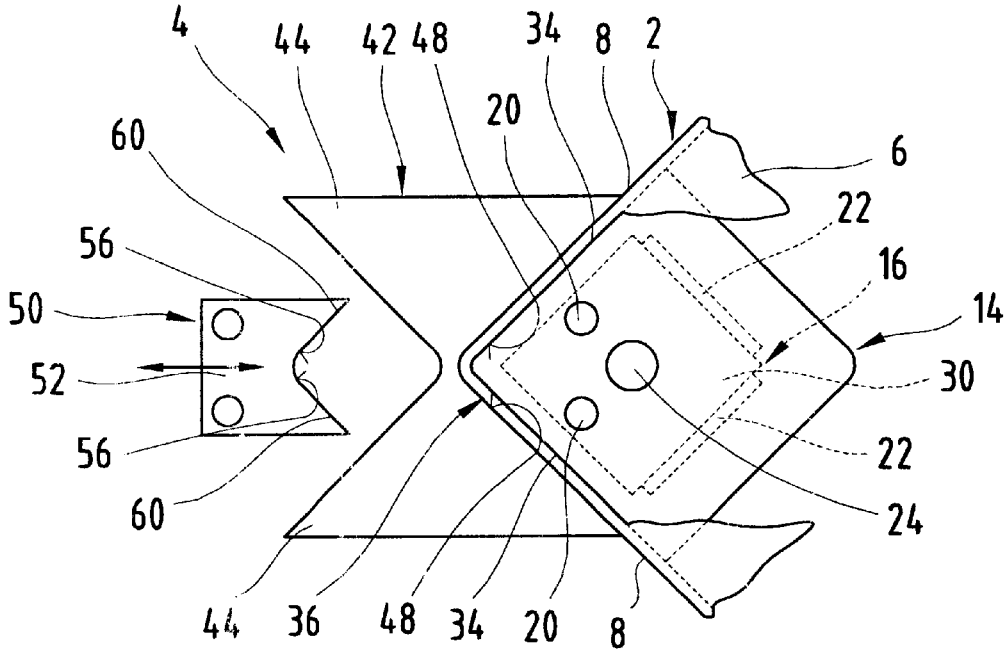
FIG. 3 is a plan view of a main part of the corner-shaping device and a box-shaped component.

In FIGS. 2 and 3, reference number 2 denotes a box-shaped component; and 4 a corner-shaping device.

Figure 7:
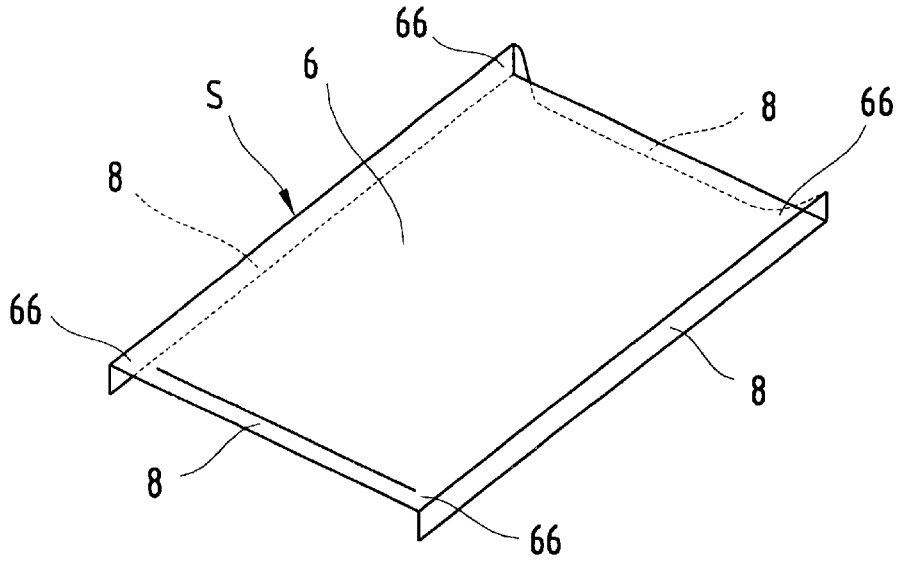
FIG. 7 is a schematic diagram of the corner regions of a plate being prepared.

As illustrated in FIG. 7, the box-shaped component 2 is made from a sheet S, such as a steel plate, an aluminium plate, a stainless steel plate, a copper plate or similar, which can be shaped by rollers. As may be seen from FIG. 15, a flat plate part 6 of the sheet S is folded along the four side edges to form four side walls 8. The sheet S is therefore shaped into a box-shaped component 2. Turning now to FIG. 2, the corner-shaping device 4 is provided with a cutting plate 14. The cutting plate 14 is supported in the horizontal direction by a frame 12. The corner-shaping device 4 is also fitted with a substantially multi-cornered plate-type tool 16. The tool 16 is fixed on the cutting plate 14. In the example illustrated as an embodiment here, the tool 16 is a square-shaped plate. The tool 16 is secured to a bearing block 18 of the cutting plate 14 by means of a centring bolt 24, pins 20 being inserted in the bearing block 18 and additional intermediate bearings 22 being disposed in between.

Figure 1:
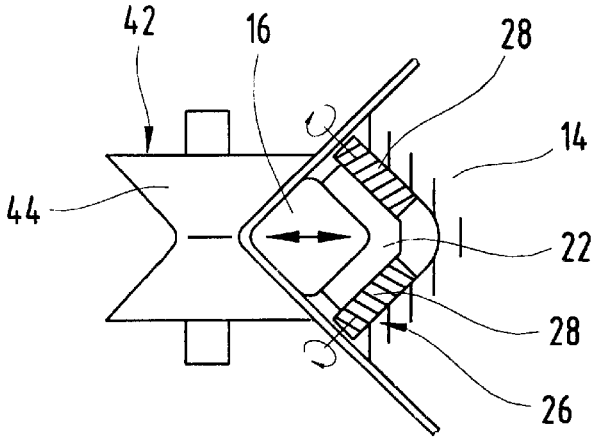
FIG. 1 is a simplified diagram on an enlarged scale and seen in plan view of a roller system and tool as used in one embodiment of the present invention.

An adjusting mechanism 26 is also disposed on the cutting plate 14. The adjusting mechanism 26 determines a position at which either the tool 16 or the roller system 42, which will be described below, is mounted. As illustrated in FIG. 1, the adjusting mechanism 26 comprises the intermediate bearing 22 and manually adjustable threaded spindles 28. The threaded spindles 28 are disposed between the cutting plate 14 and the intermediate bearings 22. The threaded spindles 28 may also be manually turned to adjust the tool 16 by a forward or retracted distance (see arrow in FIG. 1).

The tool 16 is substantially square in shape with horizontal top and bottom faces 30, 32 and four side faces 34. These four side faces 34 adjoin the top and bottom faces 30, 32.

The tool 16 is designed with a shaping surface 36 for producing the corner region 10 of a corner of the box-shaped component 2. The shaping surface comprises the top face 30 in a corner of the tool 16 and two side faces 34 communicating with this top face 30. The tool is also provided with a cutting element 38 for trimming the excess 66 or a projection (see FIG. 13) from the end region of the box-shaped component 2 once it has been fully shaped. The cutting element 38 is arranged in a region of a corner on a bottom face 32 of the tool 16 in which the two side faces 34 are joined to the aforementioned bottom face 32. A drive system 40 for the cutting element 38 displaces the cutting element 38 in the region of the bottom face 22 towards or away from the side wall 8 of the box-shaped component 2.

The corner-shaping device 4 is also provided with a substantially oppositely lying roller system 42 of a circular cone shape. The roller system 42 is displaced along the two side faces 34 forming the shaping surface 36 at a corner of the tool 16. The roller system 42 essentially forms a double, circular-based cone arrangement in which a pair of circular-based cone parts 44 are joined to one another at their tips (vertices). The roller system 42 is displaced along the two side faces 34 forming the shaping surface 36 by means of a drive system 46.

Moreover, the roller system 42 is provided with two thrust faces 48. When the roller system 42 is displaced along the two side faces 34 forming the shaping surface 36, the thrust faces 48 push the excess pieces 66 or projections in a corner of the box-shaped component 2 in such a way that the excess pieces or projections 66 are brought into direct abutting contact with the two side faces 34 where a corner region 10 is formed. The thrust faces 48 have a circular-based cone surface inclined in mutually facing directions but which extend continuously towards one another to the tip. The roller system 42 in the embodiment described here is disposed and designed so that it can not rotate relative to the two side faces 34.

Figure 4:
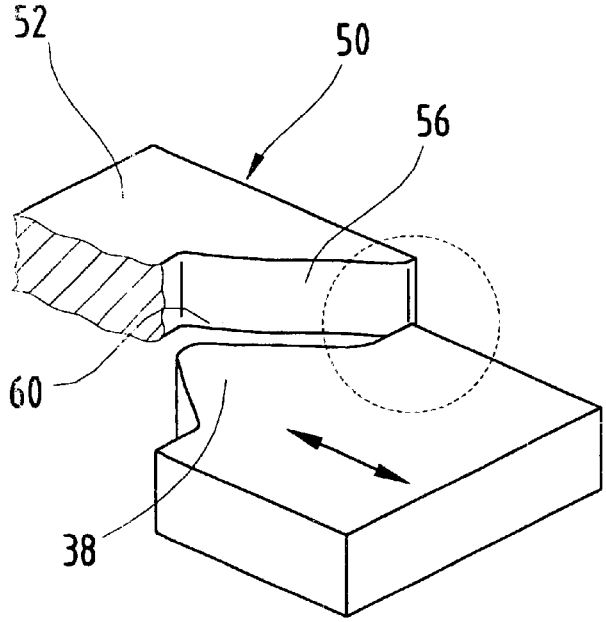
FIG. 4 is a schematic and enlarged perspective diagram depicting a fixed and a displaceable cutting element.

The corner-shaping device 4 is also provided with a support plate 50. The support plate 50 is height-adjustable in a downward direction as far as the bottom face 32 in a corner of the tool 16. As illustrated in FIGS. 2 to 4, the support plate 50 is provided with a top and bottom face 52, 54 and two internal faces 56 disposed lying opposite said side faces 34. An adjusting drive 58 for the support plate 50 displaces the support plate 50 onto and away from the side faces 34 of the tool 16 in a reciprocating motion.

The support plate 50 has a cutting edge 60, which is arranged in a region in which the bottom face 54 merges with the internal face 56. When the cutting edge 60 is displaced in the direction of the side faces 34 of the tool 16, the tool 16 and the support plate 50 hold the side wall 8 of the box-shaped component 2. Consequently, the cutting edge 60 trims off the excess piece 66 or projection of the ready-shaped corner region 10 of the box-shaped component 2 in conjunction with the cutting element 38, as the drive system 40 for the cutting element 38 displaces the cutting element 38 along the bottom face 32 of the tool 16.

Reference number 62 denotes a clamping device, which holds the flat plate part 6 of the box-shaped component 2 from a top face. Reference number 64 denotes a drive mechanism for the clamping device 62.

A description will now be given of the processing sequence in which the device outlined above is operated.

When the box-shaped component 2 with a corner region 10 has been produced using the corner-shaping device 4, the pre-processing has already been completed beforehand, as illustrated in FIG. 7. Specifically, the flat plate part 6 of the square plate-shaped sheet S, which has good roll-forming properties, is folded along the four side edges to form four side walls 8. The box-shaped component 2 still has the excess pieces (projection) 66 which results in each corner.

Figure 5:
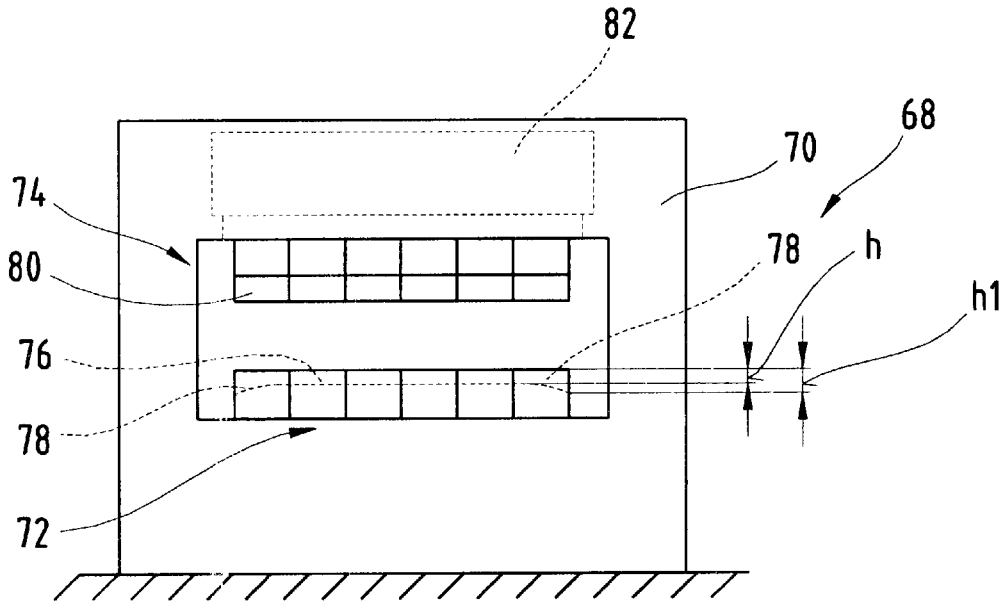
FIG. 5 is an end-on view of an edge-folding machine.
Figure 6:
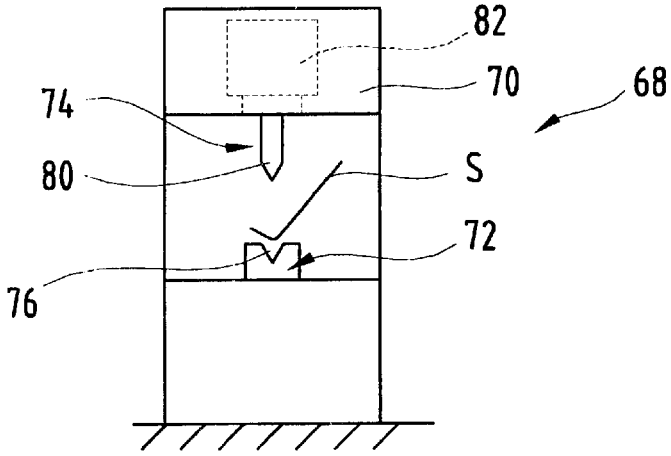
FIG. 6 is a side view, seen in section, of the edge-folding machine illustrated in FIG. 5.

As illustrated in FIGS. 5 and 6, the preliminary processing mentioned above can be implemented using an edge-folding press 68. The edge-folding press 68 is provided with a die 72 and a punch 74. The die 72 is fixed to a main body 70. The punch 74 is displaced towards the die 72.

Figure 12:
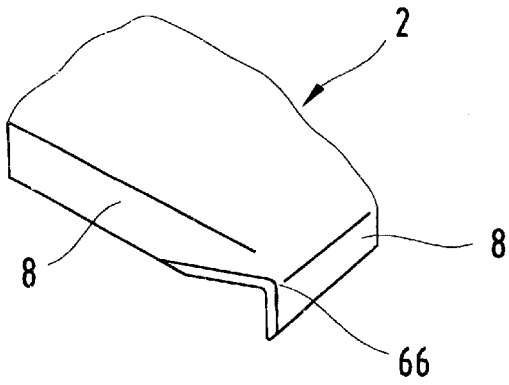
FIG. 12 is a perspective diagram on an enlarged scale, showing a main region of the box-type component before the corner regions of the box-shaped component have been made.
Figure 13:
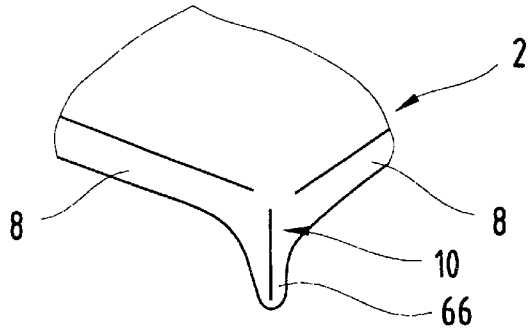
FIG. 13 is a perspective diagram on an enlarged scale, showing a main part of the box-shaped component after the corners of the box-type component have been made.

The die 72 is made with a V-shaped grooved region 76, the height "H" of which matches the height of the side wall 8 of the box-shaped component 2. The grooved region 76 is provided with a shaping region 78 at both ends of this region, in other words in regions corresponding to the corner regions 10 of the box-shaped component 2. The shaping region 78 is of a height "h1", which is greater than the height "h". The punch 74 is provided with a projection 80 having a V-shaped cross section, which complements the grooved region 76. A drive mechanism 82 drives the punch to displace it towards the die 72. As illustrated in FIG. 7, the edge-folding press 78 enables the flat plate part 6 of the sheet S to be folded along its four side edges, thereby producing four side walls, using the following two components: the die 72 with the grooved region 76 having the V-shaped cross section and the shaping region 78 in the region of the two ends and the punch 74 with the projection 80 having the V-shaped cross section. As illustrated in FIG. 12, the shaping regions 78 of the die 72 form the excess pieces 66 or projections in each corner of the box-shaped component 2, where the corresponding ends of two adjacent side walls adjoin one another.

Once the pre-forming process using the edge-folding press 68 is complete, the threaded spindles 28 of the adjusting mechanism 26 are manually pivoted, thereby shifting the tool 16 by a forward or retracted distance—as indicated by the arrow in FIG. 1.

Figure 8:
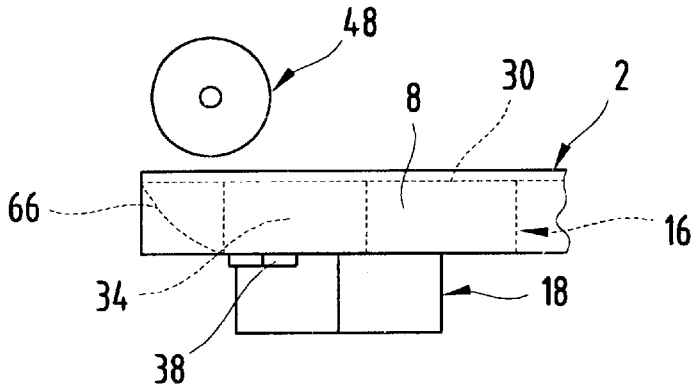
FIG. 8 is a side view showing the relative position of the roller system and the tool prior to making the corner regions.

As may be seen from FIG. 8, the side walls 8 at a corner of the sheet 1 are positioned against the side faces 34 of a corner of the tool 16 of the corner-shaping device 4, the side faces 34 forming the shaping surface 36. This being the case, the excess pieces 66 may project outwards beyond the tool 16, whilst the clamping device 62 is adjusted by means of the drive mechanism 64. As a result of this adjustment, the flat plate part 6 of the sheet S is applied against the top face 30 of the tool 16 and the sheet S is thereby fixed on the top face 30.

Figure 9:
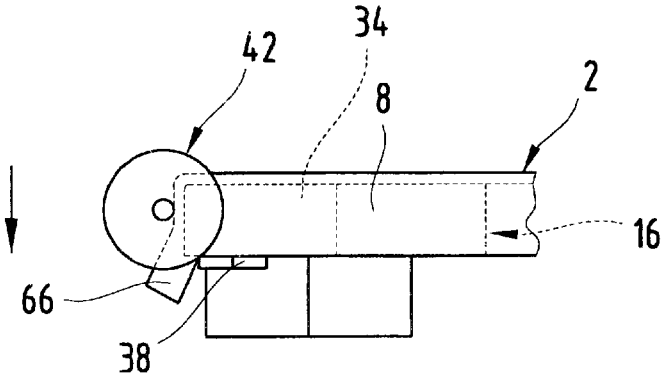
FIG. 9 is a side view of the relative position of the roller system and the tool whilst the corner region is being produced.

As illustrated in FIG. 9, once the corner-shaping device 4 is holding the sheet S on the tool 16, the drive system 46 displaces the roller system 42 in the direction indicated by the arrow (downwards in FIG. 9) along the two side faces 34 forming the shaping surface 36, whilst the thrust faces 48 of the roller system 42 are held in contact with the side walls 8 of the sheet 1. As a result, the excess piece 66 (projection) standing out beyond the tool 16 is bent so far downwards and deformed to such a degree that it sits abutting tightly against the two side faces 34.

Figure 10:
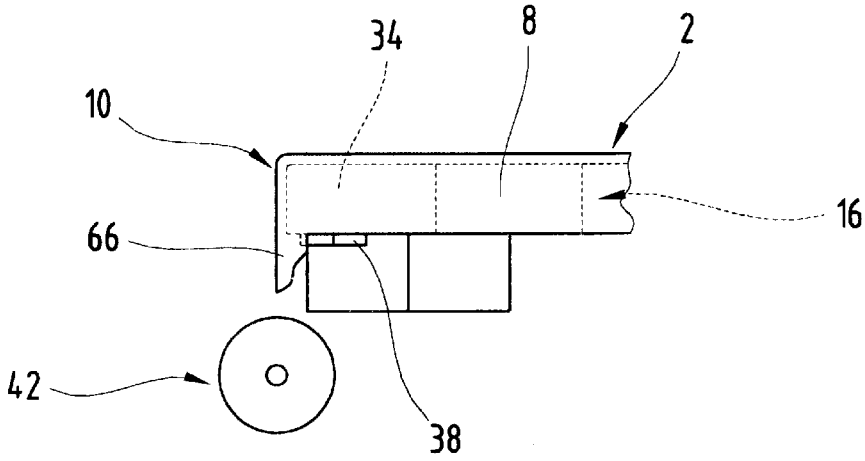
FIG. 10 shows the relative position of the roller system and the tool after the corner region has been made.

The corner region 10 of the box-shaped component 2 is produced on the corner-shaping device 4 by displacing the roller system 42 into the position illustrated in FIG. 10.

Figure 11:
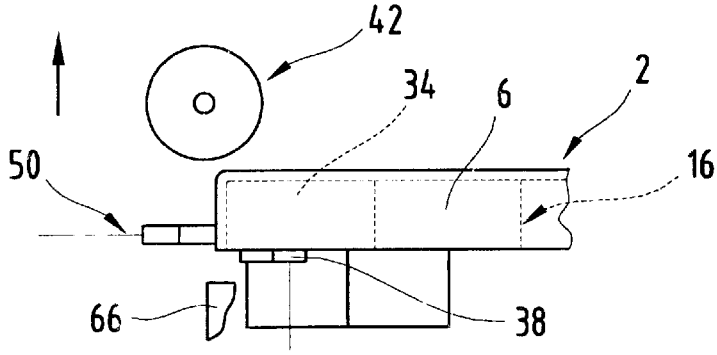
FIG. 11 shows the relative position of the cutting plate and the tool whilst the excess (projection) is being removed from the corner region.

As illustrated in FIG. 11, the adjusting drive 58 displaces the support plate 50 towards the side faces 34 of the tool 16, whilst the tool 16 and the thrust faces 48 of the roller system 42 hold the side walls 8 of the box-shaped component 2 in position. The drive system 40 then displaces the cutting element 38 along the bottom face 32 of the tool 16. The cutting edge 60 of the support plate 50 then trims off the excess piece 66 or projection from the ready-formed corner region 10 in co-operation with the cutting element 38.

Figure 14:
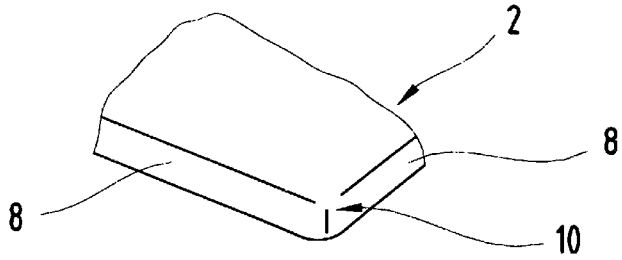
FIG. 14 is a perspective diagram on an enlarged scale, showing a main part of the box-shaped component, after the excess (projection) has been trimmed from the corner region.
Figure 15:
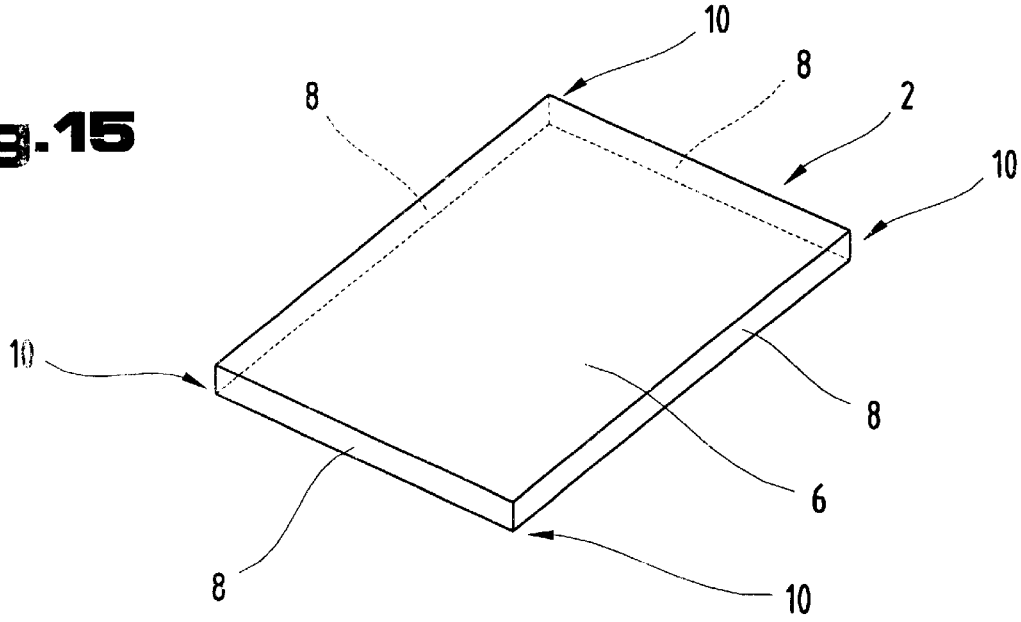
FIG. 15 is a perspective diagram of the box-shaped component with a finished corner region.

As may be seen from FIGS. 14 and 15, the box-shaped component 2 with said corner regions is finished once the excess piece 66 or projection has been removed.

The adjusting mechanism 26 permits an adjustment of the tool 16 by a forward or retracted distance and thus enables the tool 16 to be duly positioned depending on the thickness of the box-shaped component 2, obtaining a high degree of accuracy in the dimensions of the corner region 10 of the finished box-shaped component 2 and making the corner-shaping device 4 highly efficient.

In addition, once the excess piece 66 or projection has been removed from the resultant corner region 10, the adjusting drive 58 shifts the support plate 50 towards the side faces 34 of the tool 16. The tool 16 and the thrust face 48 of the roller system 40 then hold the side wall 8 of the box-shaped component 2. Moreover, the drive system 40 displaces the cutting element 38 along the bottom face 32 of the tool 16. At the same time, the cutting edge 60 of the support plate 50 in conjunction with the cutting element 38 trims off the excess piece 66 or projection.

In comparison with known devices, the corner-shaping device 4 offers a simple process for forming the box-shaped component 2 and enables the box-shaped component 2 to be provided with corner regions 10. Furthermore, the corner-shaping device 4 enables the corner regions 10 of the box-shaped component 2 to be produced at a significantly reduced cost.

The corner-shaping device 4 used for the box-shaped component 2 as proposed by the invention is not restricted by the description given above and lends itself to various adaptations or modifications, as is the case, for example, with the adjusting mechanism 26, which in this embodiment has manually adjustable threaded spindles 28 for adjusting the tool 16 by a forward or retracted distance. As an alternative, it would be possible to provide a motor-driven positioning device 92.

Figure 16:
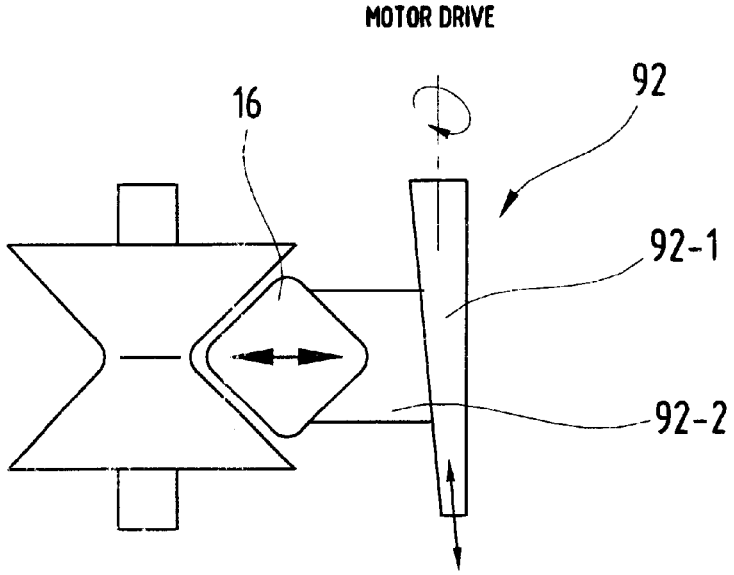
FIG. 16 is a schematic diagram on an enlarged scale, seen in plan view, showing one embodiment of the roller system and a tool as proposed by the present invention.

Specifically, as illustrated in FIG. 16, the adjusting drive 58 has a motor unit, not illustrated. A conical shaft section 92-1 can be displaced with the motor drive in a reciprocating motion and a transmission member 92-2 connects the conical shaft section 92-1 to the tool 16. The motor unit then displaces the conical shaft section 92-1 in a reciprocating motion onto this tool, which motion is then transmitted via the transmission members 92-2 to the tool 16, thereby adjusting a distance of the tool 16 forwards or backwards. In this manner, the motor drive enables the tool 16 to be shifted forwards or backwards by a distance, positioning the tool 16 as a result according to the thickness of the box-shaped component 2, which means that the dimension of the corner region 10 of the finished box-shaped component 2 will be accurate and the corner-shaping device 4 highly efficient.

Figure 17:
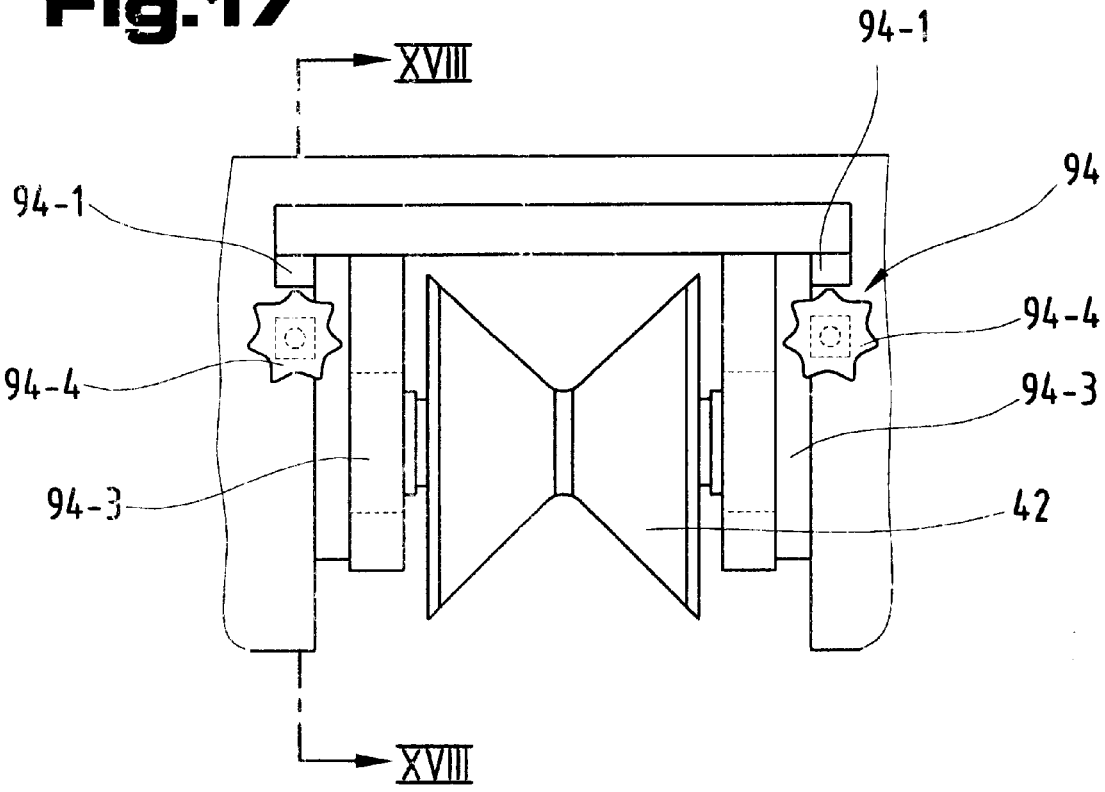
FIG. 17 is a schematic diagram giving an end-on view of another embodiment of the roller system.
Figure 18:
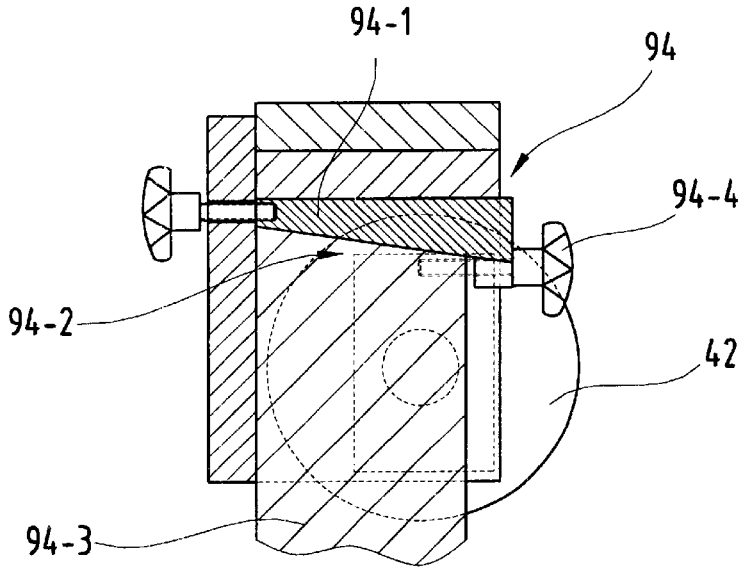
FIG. 18 shows the roller system illustrated in FIG. 17, seen in section along the lines 18—18 of FIG. 17.

As an alternative, it would also be possible to provide a pair of positioning mechanisms 94 in the region of the roller system 42. In particular, as illustrated in FIGS. 17 and 18, the positioning mechanisms 94 may comprise a pair of wedge-shaped means 94-1, a pair of adjusting means 94-3 which slide on correspondingly inclined surfaces 94-2 of the wedge-shaped means 94-1 and a pair of motion control parts 94-4 to displace the corresponding adjusting means 94-3.

When the positioning mechanism 94 is activated, the motion control parts 94-4 are rotated in a predetermined direction, causing the moving adjusting means 94-3 to be displaced so that the moving adjusting means 94-3 slide on the inclined surface 94-2. This being the case, the roller system 42, which is connected to the moving adjusting means 94-3, can be positioned relative to the tool.

In another embodiment, the positioning mechanism 94 may be provided adjacent to both, namely tool 16 and roller system 42, in order to obtain greater accuracy depending on the formatting process and to produce the box-shaped component 2 with corners. This system affords a further improvement in terms of ease of processing and processing quality.

Figure 19:
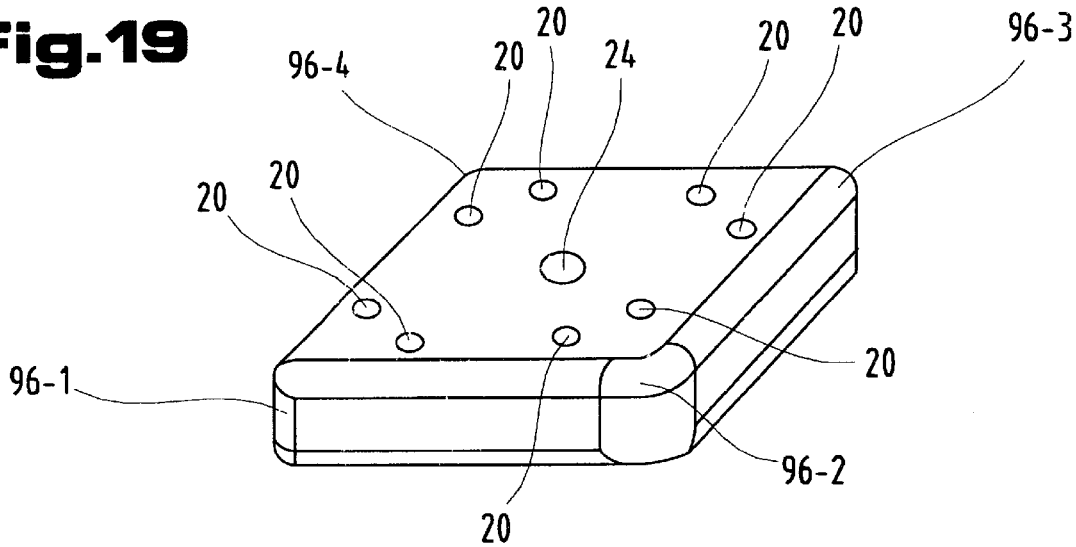
FIG. 19 is a perspective diagram of another embodiment of the tool.

Furthermore, as a result of this embodiment of the present invention, only one type of shaping surface 36 is produced with this format of the tool 16 and is so by the top face in one corner of the tool 16 and two side faces 34 adjoining said top face. As an alternative—as illustrated in FIG. 19—it would also be possible to provide corners of the square-shaped tool 16 with one to four shaping surfaces 96-1, 96-2, 96-3 and 96-4, e.g. the four corners themselves. These shaping surfaces could be made with different dimensions.

A centring bolt 24 is pulled out of a central region of said tool 16 and the tool 16 is pivoted to a predetermined position of the tool 16 before the tool 16 is secured again using the pins 20 and the centring bolt 24. With this approach, the dimensions in the corner regions 10 of the box-shaped 2 component can be easily modified, which also makes the system more convenient during operation.

Figure 20:
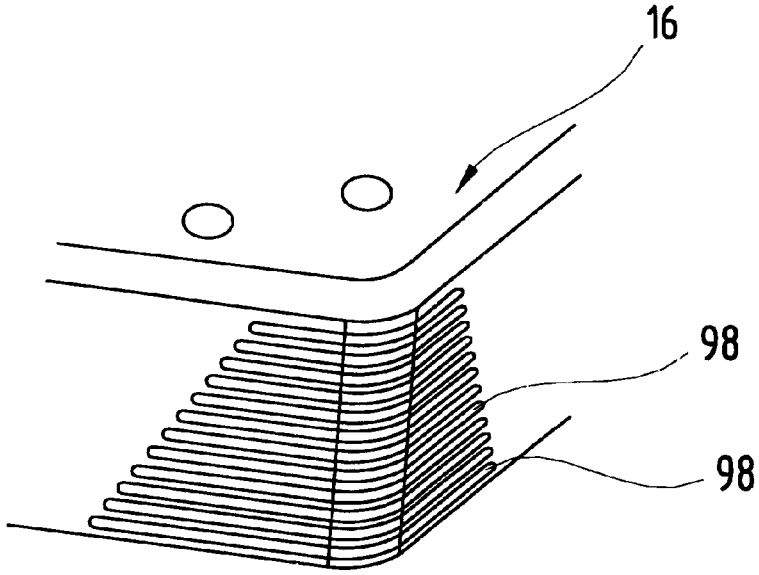
FIG. 20 is a perspective diagram on an enlarged scale showing a main part of another embodiment of the tool.

If a bendable metal material such as aluminium is used for the box-shaped component 2, the material will shift, for example due to gravitational force, when the deformable metal material is moved downwards as the corner regions 10 of the box-shaped component 2 are being formed. As illustrated in FIG. 20, the tool 16 may be provided with a plurality of horizontal groove-shaped regions 98 in each of the corners.

These groove-shaped regions 98 may be made as grooved regions 98-1 with a triangular cross section, as illustrated in FIG. 21*a*, or grooved regions 98-2 with an arcuate cross section, as illustrated in FIG. 21*b*. When the box-shaped component 2 with the corner regions 10 is made by means of the roller system 42, each corner of the box-shaped component 2 will then be pressed into the groove-shaped regions 98, duly preventing any shifting of the material due to gravitational force. This embodiment avoids any problems with regard to the accuracy of the angle subtended in the corner regions 10 of the box-shaped component 2 and also offers advantageous options for producing corner regions 10 on a box-shaped component 2.

As explained in the above description of the present invention, the present invention relates to a corner-shaping device 4 with an adjusting mechanism 26 for adapting to a box-shaped component 2 and a method of forming a corner bounded by three sides from a flat, plate-shaped material, in particular sheet metal, in which the side edges adjacent to the corner can be folded back parallel with the flat plate part 6 across a large part of their longitudinal extension and shaped, in the region where the corner is to be formed, from the folded-down side edge to the plane of the flat sheet-part 6, along a curved path, wherein the pre-formed blank is formed by material deformation by means of at least one roller system 42, spanning the corner region 10 between the side edges, which applies the curved transition region against a die plate and the corner, characterised in that the side edges in the region of the corner are applied across their entire height against the peripheral end faces of the die plates. Consequently, the adjusting mechanism 26 enables at least one tool 16 and a roller system 42 to be adjusted by forward or retracted distances, the tool 16 being duly positioned depending on the thickness of the box-shaped component 2 and producing the corner regions 10 of the finished box-shaped component 2 to a high degree of dimensional accuracy whilst making the corner-shaping device 4 very economical. In addition, compared with the devices known until now, the corner-shaping device 4 set up to produce the box-shaped component 2 as proposed by the present invention offers a very simple forming process and enables the box-shaped component 2 to be provided with angled parts. Used to produce corner regions 10 in a box-shaped component 2, such a device also makes for a significant reduction in costs.

FIGS. 22 and 23, which will be described together, illustrate another embodiment of a system 101 incorporating the corner-shaping device 4 for forming flat sheet materials, in particular the component 2, the same reference numbers being used for elements already described above. A system 101 of this type is specifically used for producing corners bounded by three sides on the component 2, e.g. to produce safes, covers, doors, etc., for example for use in system cabinets, from sheet-shaped blanks. A machine frame 104 of the system 101 supported on a stand surface 103 essentially consists of a bearing frame 105 disposed vertically on the stand surface 103, the plate-shaped cutting plate 14 extending parallel with the stand surface 103, a guide device 107 and a locking device 108 co-operating therewith and, if necessary, a safety door 109 forming a safety feature which can be opened and/or closed with the clamping device 62 specifically provided for this purposely. The flat-shaped cutting plate 14, which for practical purposes may be detachably joined to the bearing frame 105 or welded thereto, is preferably fitted with an adjusting mechanism 112 and a cutting device 113 on a top face 111 remote from the stand surface 103. The cutting plate 14, which for practical purposes may be made from steel, has a substantially rectangular basic contour with a width 114 and a length 115 measured perpendicular thereto. The tool 16 co-operating with the adjusting mechanism 112 is displaceable relative to the roller system 42. The guide device 107 vertically disposed on the cutting plate more or less in the region of the half width 114 consists of two guide elements 118 spaced at a distance apart from one another. The locking device 108, which is adjusted by means of the guide device 107 via a linking device 119, is formed by two plate-shaped supporting elements 120 spaced at a distance apart from one another in the direction of the length 115, the roller system 42 being arranged between them. For practical purposes, the roller system 42 is rotatably mounted by bearing elements inserted in the supporting elements 120. The connection of the two supporting elements 120 with another connecting element forms a compact unit forming the locking device 108, which is retained by the connecting device 119. The connecting device 119 is co-operatively connected to a manually and/or automatically and/or semi-automatically operated replacement device 121. When a fast-closing element 122, in particular a lever 123 etc., of the replacement device 121 is operated, the connecting device 119 arranged between the locking device 108 and the guide device 107 is shifted from a locked position into a released position. Clearly, the replacement device 121 may also be built from pneumatic and/or hydraulic and/or electrical and/or electro-pneumatic and/or electro-hydraulic elements 122.

A roll 125, widely known from the prior art, mounted so as to rotate about a central axis 124, essentially consists of two frustoconical bodies in mirror image, tapering towards one another in a conical arrangement and merging with one another into a rounded transition region. Consequently, the horizontally aligned roll 125 has a contour in the shape of an hour glass. The gradient of the frustoconical bodies determines the angle of the corner to be formed. The guide elements 118 disposed vertically from the guide device 107 to the stand surface 103 are detachably and/or non-detachably joined to the machine frame 104. The guide device 107, which may be cooperatively linked to one and/or more drive units 126 enables the roller system 42 to be displaced towards the guide elements 118 relative to at least one tool 116, enabling the folded-back edges of the component 102 to be produced. For practical reasons, the drive unit 126 is operated by a hydraulic cylinder because it is economical and powerful. Clearly, any other drive systems 126 known from the prior art could be used, such as electric drives, e.g. spindle drives, etc.

The adjusting mechanism 112 of the corner-shaping device 4, which can be displaced and/or positioned and/or fixed relative to the roll 125 by means of the drive unit 126, forms at least one plate-shaped, multi-cornered, in particular polygonal sliding element 127, practically made from a single piece, comprising five longitudinal end faces 128 of the same dimensions facing away from one another and a top face 129 and bottom face 130 extending perpendicular thereto. As may also be seen from FIG. 23, the tool 16 detachably and/or non-detachably mounted on the top face 129 projects for practical purposes beyond at least one longitudinal end face 128 facing the roll 125. By preference, a projection 131 arranged perpendicular to the bottom face 130 stands proud in the bottom region thereof at least partially beyond the longitudinal end face 128 facing away from the roll 125, the purpose of which will be discussed in more detail below.

The cylinder contours 132, formed by the outline of the roll 125, extending towards one another in the direction of the central axis 124, subtend an acceptance angle 133 between the two cylinder contours 132 and form a distance 134 between the contour of the roll 125 and the tool 16 which can be adjusted by means of the adjusting mechanism 112 and set to suit the component to be formed, in particular its wall thickness. In practical terms, an axis of symmetry 135 running along a fictitious dividing place between the two frustoconical bodies of the roll 125 is congruent with an axis of symmetry 136 of the adjusting mechanism 112. The two longitudinal end faces 128 of the sliding element 127 directed towards the cylinder contours 132 preferably run approximately parallel with these. The two oppositely lying longitudinal end faces 128 acting as a slide track 137 extend at least at an angle to the two oppositely lying cylinder contours 132, the angle 138 subtended by the slide track 137 and the axis of symmetry 136 being smaller than and/or the same as and/or bigger than half the acceptance angle 133 of the roll 125. An approximately V-shaped counter plate 139 adjoining the projections 131 has two legs 140 widening relative to one another by approximately half the acceptance angle 133, between which a base 141 joining the legs 140 extends. The legs 140 form another slide track 143 on one of the longitudinal end faces 142 directed towards the cylinder contour 132 and extending parallel therewith. The width of the leg 140 measured perpendicular to the cutting plate 14 is greater than a width of the base 141, so that, by providing an approximately trapezoidal plate 144, the path of the slide element 127, the legs 140 and the plate 144 is flat. By preference, the plate 144 is locked on the base 141 and between the two legs 140 by means of a connecting element known from the prior art.

A guide track 145 formed by the projection 131 and the two oppositely lying slide tracks 137 and 143 encloses and guides a longitudinally displaceable slide block 146. On a longitudinal end face directed towards the slide track 137, the slidable plate-shaped slide block 146 has an inclined positioning surface 147 running parallel with the slide track 137, the slide block 146 being free to effect a relative displacement of the tool 16 located on the slide element 127 by means of the drive system 148 in the direction of double arrows 149 and 150. At least one longitudinal scale bar 151 co-operates with the slide blocks 146 and is preferably mounted on the top face of the legs 140, serving as an indicator for the displacement path along double arrows 149 and 150. The plate 144, detachably and/or non-detachably mounted on the base 141 and/or the cutting plate 14, having a recessed compartment 152 disposed in the direction of the axis of symmetry 136, has a thread arrangement 154 with a threaded spindle 153 projecting through it in the region of the base surface of the compartment 152 towards the slide blocks 146.This may be a high-precision threaded spindle or a pre-tensed threaded spindle 153, etc., which enables the tool 16 to be precisely displaced or positioned relative to the roll 125 due to its high-precision finish. Clearly, it would also be possible to use cheaper threaded spindles 153, the clearance of which could be compensated by means of a spring system, not illustrated, disposed between the slide block 146 and the plate 144. Due to the accessibility afforded via the compartment 152, the torque needed to displace the slide blocks 146 can be applied. The option of providing the separate in-feed of the two slide blocks 146 permits an asynchronous displacement of the tool 16 perpendicular to the axis of symmetry 135.

It has been found to be of particular advantage if an angle of inclination 155 formed by the slide block 146 provides a transmission ratio dependent on gradient such that even if the displacement path of the slide blocks 146 is short, the displacement path of the tool 16 can be adjusted in proportion to the transmission ratio. A design of this type considerably reduces the overall size of the drive system 148, slide element 127 and counter plate 139 as a unit.

Clearly, it would also be possible to provide only one slide block 146, also mechanically operated. Another drive system 148, not illustrated, may be provided, for example in the form of a counter-running threaded spindle 153 with slide blocks 146 displaceable in the opposite direction and locked thereon which would move towards or away from one another depending on the drive direction. The advantage of this design is the synchronous drive of the two slide blocks 146 and hence the uniform in-feed in both directions along the double arrows 149 and 150. In principle, the distance 134 can be manually and/or automatically and/or semi-automatically adjusted by any drive systems 148 known from the prior art, such as cranks, levers, etc., or may be operated by electric, hydraulic or pneumatic drives.

Clearly, it would also be possible to set up a digital control system, which would incorporate the control specifications linking the individual axes for displacing the tool 117 and process the signals in a control system accordingly, so that positioning for the distance 134 can be set, accurately repeated and adjusted.

As may also be seen from FIG. 23, the cutting plate 14 is fitted with the cutting device 113 with two plate-shaped cutting elements 157, 158 detachably and/or non-detachably mounted on a holder 156 and/or the cutting plate 14. By preference, the cutting device 113 is positioned along the axis of symmetry 136 and downstream of the adjusting mechanism 106. The cutting device 113 may naturally be positioned at any point of the cutting plate 14 and/or including on an external device, not illustrated. In practical terms, one cutting element 157 joined to the holder 156 and/or the cutting plate 14 extends flush with the top face 111 of the cutting plate 14 and the other cutting element 158 is set back in the direction perpendicular to the axis of symmetry 136. The cutting device 113, which is preferably remotely operable, may be built on and/or integrated in the cutting plate 14.

The holder 156 is provided in the form of a cross member 159 arranged lengthways in a clearance of the cutting plate 14, which holds the cutting element 154 on the top face 111. As may also be seen in this embodiment, the holder 156 co-operates with a drive system 160, co-operatively connected to the cutting element 158, which enables a relative displacement of the cutting element 158 towards the cutting element 157. In this case, the drive system 160 is provided in the form of a hydraulic unit, a cross member 161 which receives the cutting element 158 being guided along two track rods 162 spaced at a distance apart. A cutting edge 163 formed by the cutting element 157 projects at least partially beyond a cutting edge 164 of the cutting element 158 in the operated state. On an end face surface 165 directed towards the cutting element 158, the plate-shaped cutting element 157 has a triangular shaped clearance 166 formed by the two cutting edges 163 running at an incline towards one another, the acceptance angle 167 of which corresponds for practical purposes to the acceptance angle 133. The cutting element 158 lying opposite the cutting element 157, having a recessed, plate-shaped end face surface 168, has an apex 169 formed by two cutting edges 164 running at an incline towards one another, the cutting edges 164 extending parallel with the cutting edges 163. On the base of the apex 169, the oppositely lying end regions of the cutting edges 164 have an oblique boundary edge 170 preferably extending perpendicular to the axis of symmetry 136. The component 2 requiring further processing can be placed on a bearing surface 171 directed towards the cutting element 157 and aligned perpendicular to the boundary edge 170. Clearly, the cutting device 13 may be provided in the form of a cutting element 157 and a guide element, in which case the cutting element 157 is provided with the cutting edges 163 and the guide element merely acts as a stop during the cutting process. The cutting edges 163 and 164 formed by the cutting elements 157 and 158 may be formed at least in part by the end face surface 165 and 168 of the cutting element 157 and 158 and/or by locked inserts. The major advantage of locked inserts is that locking inserts can be changed easily and rapidly incurring low tool costs.

For practical reasons, only one cutting element 158 is displaceable and is displaced by means of the drive system 160 relative to the cutting element 157, which is preferably permanently fixed. The drive system 160 may naturally be selected form any of the drive systems known from the prior art, for example hydraulic, pneumatic, electro-hydraulic cylinder-piston system, electric actuator drives, etc.. Clearly both cutting elements 157 and 158 could also be displaceable relative to one another and/or could be arranged so that a displaceable cutting element 157 or 158 cooperates with a stationary cutting element 158 or 157.

FIGS. 24 and 25 provide a detailed illustration of the corner-shaping device 4. The plate-shaped tool 16 is positioned by means of the centring bolt 24 on the slide element 127, which is displaceable relative to the cutting plate 14, and is secured by means of at least one fixing screw 172. The tool 16 forms the shaping surfaces 36. The tool 16 is essentially of a square-shaped basic contour, the centring bolt 24 being disposed centrally relative to the shaping surfaces 36 which are arranged perpendicular to one another, as a result of which the tool 16 can be used in positions pivoted respectively by 90 degrees about the centring bolt 24 or about a vertically extending pivot axis 173, without changing the position relative to the slide element 127. To this end, the tool 16 has at least four mountings 174 for the fixing screws 172 assigned to the corner regions. This enables the shaping surfaces 36 to be made to different designs in terms of their rounding or structure in order to be able to shape different corner regions 10 on the box-shaped component 2.

In order to shape the corner region 10 and make the side walls 8, the pre-formed component 2 is placed against the shaping surfaces 36 of the tool 16 and fixed to the tool 16 by the clamping device 62. The clamping device 62 consists of a clamping plate 175, which is immovably joined to the safety door 109, for example, and displaced in conjunction therewith. In order to produce sufficient clamping force, another clamping element 176 is provided, for example, which may be a pressurised clamping cylinder 177 applying a clamping force in the direction of the tool 16 or the component 2 placed on the tool 16.

Once the component 2 has been sufficiently clamped on the tool 16, the corner region 10 is shaped by displacing the roller system 42 in the guide elements 118 in the direction of arrow 178 and into the end position of the roller system 42 shown in FIG. 25, during which process the corner region 10 is shaped and lies against the shaping surface 36 of the tool 16 by means of a resultant projection. The decisive factor in producing the exact shaping of the corner region 10 is to ensure that the distance 134 between the shaping surface 36 and the outline of the cylinder contour 132 is adjusted exactly. Exact corner shaping is produced by setting the distance 134 to the lowest nominal dimension of a thickness 179 of the component 2.

It is also of crucial importance that a distance 180 between a front edge 181 of the clamping plate 175 directed towards the roller system 42 and the cylinder contour 132 of the roller system 42 is only a few tenths of a millimeter. This avoids any counter forming of the corner region 10 of the box-shaped component 2. By setting the distance 134 to the lowest nominal dimension of the corner 179 of the component 2, any tolerance limits there might be can be compensated and the corner aligned exactly at a right-angle in the corner region 10 of the component 2. A positive tolerance of the thickness 179 causes the component 2 to be roll-formed in the corner region 10 between the shaping surface 36 of the tool 16 and the roller system 42.

The distance 134 between the shaping surface 36 and the roller system 42 is adjusted by means of the adjusting mechanism 112, by means of which the sliding element 127 can be adjusted relative to the cutting plate 14 and to the roller system 42. A central plane running perpendicular to the cutting plate 14 along which the roller system 42 is displaced and a minimum diameter 182 of the dual-cone roller system 42 in the corner region 10 acts as a reference measurement.

As illustrated in FIG. 25 for example, in order to produce perfectly formed corners, a spray nozzle 183 co-operating with the clamping plate 175 is also provided, supplied via a line 184 with lubricating and coolant fluid so that lubricating and coolant fluid can be applied prior to the forming process, in particular to an inclined surface of the clamping plate 175, from where this lubricating and coolant fluid is transferred to the shaping region by force of gravity. Since the smallest of quantities will suffice and too large quantities are to be avoided in any case, the lubricating and coolant fluid is applied via a metering device, not illustrated, of the spray nozzle 183.

FIGS. 26 and 27 provide a detailed illustration of the cutting device 113 of the corner-shaping device 4. On the cutting plate 14, the stationary cutting element 157 is detachably secured by a bottom face 186 extending parallel with the cutting plate 14, e.g. at a distance 187 from the cutting plate 14 by means of a spacing batten 185. Accordingly, the cutting element 157 acts as a cutting edge 163 projecting beyond the spacing batten 185 in the direction of the displaceable cutting element 158, formed by the bottom face 186 and an end face 188 extending perpendicular to the cutting plate 14. The distance 187 corresponds more or less to a thickness 189 of the displaceable cutting element 158, which is guided on the cutting plate 14 in a linear displacement driven by the drive system 160, e.g. a pressurised cylinder, and forms the cutting edge 164 with the front end face 168 and a top face 190.

On an end face 188, the cutting element 157 is provided with a V-shaped cut-away 191 adapted to the corner region 10 of the component 2 to be cut, directed towards the cutting element 158. The displaceable cutting element 158, on the other hand, has a nose-shaped projection 192 opposite the stationary cutting element 157 which is of the same shape as the cut-away 191 and forms the front end face 168. Clearly, the cut-away 191 has an internally rounded contour in the corner region 10 adapted to the component 2 and the projection 192 has a matching externally rounded contour.

When shaping the corners, in order to trim and remove the projection 194 standing out from the resultant end faces 193 of the side walls 8 in the corner region, the component, with its opening directed towards the displaceable cutting element 158, is manually positioned with the end faces 193 flat against the latter and the corner region 10 in the cut-away 191. When the cutting element 158 is displaced by the drive system 160 towards the stationary cutting element 158, an exact cut is made flush along the end faces 193 of the component 2 in the corner region 10, thereby removing the projection 194.

A cutting device 113 of this type does not necessarily have to be mounted directly on the system 101 but may be provided as a separate, detached cutting device 113.

FIG. 28 provides a schematic illustration of another embodiment of the cutting device 113. In this embodiment, the component 2 to be cut is laid on a base plate 195 with its opening and the side walls 8 projecting upwards. Mounted opposite the base plate 195 is a carriage system 197 which can be displaced at a right angle towards the latter by means of drive 196. This carriage system 197 has a tool holder 198, which bears the stationary cutting element 157 and the cutting element 158 displaceable by means of the drive system 160, the latter being guided on the tool carriage 198 in a guide arrangement 199.

When the component 2 is placed on the base plate 195 in readiness for the cutting process, an infeed is activated by the drive 196 of the tool holder 198 in the direction of arrow 200, until the displaceable cutting element 158 bears on the end faces 193 of the side walls 8 with a bottom face 201. The bottom face 201 of the displaceable cutting element 158 is aligned flush with a top face 202 of the stationary cutting element 157. The cutting position has therefore been reached 1and the displaceable cutting element 158 is displaced via the drive system 160 in the direction of arrow 203 and hence towards the stationary cutting element 157 until the side wall 8 of the component 2 bears on the end face 188 of the stationary cutting element 157. As displacement continues in the direction of arrow 203, the projection 194 produced when shaping the corner is trimmed exactly flush with the end faces 193 due to the co-operation of the cutting edges 163, 164 with the cutting elements 157, 158. After the cutting process, the tool holder 198 is displaced by the drive 196 in the direction opposite arrow 200 into an open position at a distance from the base plate 195, after which the component 2 can be removed from the cutting device 113.

As may also be seen from FIGS. 26 and 27 described above in relation to the cutting device 113, as the projection 194 is trimmed, an exactly flush path to the end faces 193 of the side walls 8 is achieved due to the fact that bearing elements 205 forming guide surfaces 204 are provided, either on the cutting plate 14 or separately from it or from the machinery 101, on which the component is laid by its end faces 193 of the side walls 8 and in its corner region 10 with the projection 194 projecting between the cutting elements 157, 158. The cutting elements 157, 158 are arranged so that the cutting edge 163 of the cutting element 157 and the cutting edge 164 of the cutting element 158 are disposed running in the guide surface 204 formed by the bearing elements 205. As the cutting process proceeds, i.e. by displacing the displaceable cutting element 158 relative to the stationary cutting element 157, the projection 194 standing out by a height 206 of the side walls 8 is trimmed exactly flush in order to achieve the height 206 of the side walls 8, even in the corner region 10, without any discrepancy.

As may also be seen from the broken lines of FIG. 27, another option is to provide the displaceable cutting element 158 with bearing elements 205 on it in the form of projections, so that the component 2 is supported by its side walls 8 in the immediate vicinity of the corner region 10 to be cut.

Turning back to FIG. 23, the roller system 42 consists of a roll 125 in bearings 207 of a rotatably mounted mounting frame 208. Accordingly, a support frame 209 is provided, which can be displaced in the guide elements 118 by means of the drive unit 126 in a direction perpendicular to the cutting plate 14, forming a guide housing 210. The guide elements 118 therefore form a guide device 211 for the guide housing 210. As a result, the corner-shaping device 4 can be rapidly fitted with rolls 125 of different designs, the cylinder contour 132 of which is adapted to the corner region 10 that will be produced on the component 2. The replacement device 121 has fast-closing elements 122, e.g. levers 123, enabling the change to be made quickly and without the need for any complex tools.

As may also be seen from FIG. 25, a height 212 of the tool 16 or the peripheral shaping surfaces 36 is greater than the height 206 of the side walls 8 of the component 2. In any event, the height 212 of the shaping surfaces 36 amounts to a measurement corresponding to the height 206 of the side walls 8 plus an anticipated height 213 of the projection 194. As a result, this ensures that when shaping the corner region 10, the projection 194, once formed by the roll, will always lie flat in the region of the shaping surfaces 36 and will not be drawn in against the bottom face of the tool 16 under any circumstances, which would result in jamming, making it more difficult to remove the component 2 once the corner region 10 had been formed.

FIG. 29 illustrates another embodiment of the roller system 42 with the clamping device 62, the same reference numbers being used to denote the same components described above in respect of the other drawings. Provided in a guide device 107 arranged on the machine frame 104, e.g. two guide rods 220 extending perpendicular to the cutting plate 14 and spaced at a distance apart from one another, is a guide carriage 221 which is mounted so as to be displaceable in a vertical direction relative to the cutting plate 14. The guide carriage 221 is driven by means of an actuator cylinder 224 disposed in the machine frame 104 or on a cantilever 222 disposed opposite the cutting plate 14, for example, drivingly linked to the guide carriage 221 via a piston rod 223 and operated by means of a pressurised medium, e.g. hydraulic oil. Naturally, it would be conceivable to use other types of drives to drive the guide carriage 221, such as electrically driven spindle drives, etc.

A cartridge 226, which can be changed by means of the replacement device 121, is retained in the guide carriage 221 by a U-shaped bracket 225. In side arms 227, 228, this cartridge 226 provides a bearing for the roll 125 so that it can rotate about the central axis 124 extending parallel with the cutting plate 14. The side arms 227, 228 are arranged at a distance from the cutting plate 14 and are joined by means of a base arm 229 extending parallel with the latter which abuts with a head plate 230 of the guide carriage 221 arranged in parallel in order to transfer the compression force applied by the actuator cylinder 224 in the direction of arrow 231 towards the cutting plate 14 to the cartridge 226 and roll 124 as well as a clamping plate 232 of the clamping device 62, also displaceably arranged in the cartridge 226.

The clamping plate 232 is displaceable perpendicular to the cutting plate 14 and is guided by guide posts 233 in guide elements 234 disposed in the base arm 229, e.g. guide bushes 235. Between the clamping plate 232 and the base arm 229, coil springs 236 of a spring arrangement 237 enclose the guide posts 233, as a result of which a maximum distance 238 between oppositely facing surfaces of the base arm 229 and the clamping plate 232 is achieved due to a corresponding abutting arrangement between the guide posts 223 and the base arm 229.

The clamping device 62 with the clamping plate 232 is arranged in the cartridge 226 relative to the roll 125 in such a way that the end faces 181 of the clamping plate 232 directed towards the V-shaped contour of the roll 125 are set back by the distance 180, which is in the order of approximately 1/10 mm.

A clamping surface 239 of the clamping plate 232 directed towards the cutting plate 14 is provided on the machine frame 104 and the plate part 6 receiving the tool 16, provided as a means of shaping the corner region 10, in particular a shaping block 240, is provided on the cutting plate 14, being displaceable and fixable relative to the internal contour of the roll 125 directed towards it by means of its shaping surface 96 facing the roll 125, as described in detail above with reference to the preceding drawing. It should also be pointed out that the shaping block 240 is pivotable, relative to a positioning pin 241 arranged at the geometric centre point of the shaping block 240, the fixing arrangement of which is designed accordingly, respectively by 90° in a plane extending parallel with the cutting plate 14.

If a pre-formed plate part 6, on which the side walls 8 have been pre-formed, e.g. by an edge-folding process, now requires shaping in the corner region 10, it is laid on the shaping block 240 so that the side walls 8 and the corner region 10 overlap with the shaping surfaces 96 of the shaping block 240. In order to run the forming process of the corner region 10, the drive or the actuating cylinder 224, for example is pressurised, and the cartridge 226 together with the roll 125 and the clamping device 62 is displaced in the direction of the shaping block, as a result of which the clamping plate 232 clamps the plate part 6 tightly against the shaping block 240. During the subsequent displacement of the cartridge 226 in the direction of arrow 231, the spring arrangement 237 of the clamping device 62 is compressed and the compression force continuously increased until the roll 125, which in its starting position is on a higher level than the clamping surface 239, effects the shaping process in the corner region 10 of the plate part 6, during which the irregularly pre-formed corner region 10 is pressed against the shaping surfaces 96 of the shaping block, thereby reaching the right-angled position of the adjoining side faces 8 in the corner-region 10.

Finally, it should finally be pointed out that the individual parts and components or groups of components of the embodiments described above are illustrated in a simplified schematic form. Furthermore, the individual parts of the combinations of features incorporated in the embodiment described may be construed as independent solutions proposed by the invention.

In particular, subject matter relating to the individual embodiments illustrated in FIGS. 1 to 15; 16; 17, 18; 19; 20; 21*a*, 21*b*; 22, 23; 24, 25; 26, 27; 28 can be construed as independent solutions proposed by the invention. The tasks and solutions can be found in the detailed descriptions relating to these drawings.

List of Reference Numbers

S Sheet
2 Component
4 Corner-shaping device
6 Plate part
8 Side wall
10 Comer region
12 Frame
14 Cutting plate
16 Tool
18 Bearing block
20 Pin
22 Intermediate bearing
24 Centring bolt
26 Adjusting mechanism
28 Threaded spindle
30 Top face
32 Bottom face
34 Side face
36 Shaping surface
38 Cutting element
40 Drive system
42 Roller system
44 Cone parts
46 Drive system
48 Thrust face
50 Support plate
52 Top face
54 Bottom face
56 Internal face
58 Adjusting drive
60 Cutting edge
62 Clamping device
64 Drive mechanism
66 Excess piece
68 Edge-folding press
70 Main body
72 Die
74 Punch
76 Grooved region
78 Shaping region
80 Projection
82 Drive mechanism
92 Positioning device
92-1 Shaft section
92-2 Transmission member
94 Positioning mechanism
94-1 Means
94-2 Surface
94-3 Adjusting means
94-4 Motion control part
96 Shaping surface
96-1 Shaping surface
96-2 Shaping surface
96-3 Shaping surface
96-4 Shaping surface
98 Region
98-1 Grooved region
98-2 Grooved region
101 System
103 Stand surface
104 Machine frame
105 Bearing frame
107 Guide device
108 Locking device
119 Safety door
111 Top face
112 Adjusting mechanism
113 Cutting device
114 Width
115 Length
118 Guide elements
119 Connecting device
120 Supporting element
121 Replacement device
122 Fast-closing element
123 Lever
124 Central axis
125 Roll
126 Drive unit
127 Sliding element
128 Longitudinal end faces
129 Top face
130 Bottom face
131 Projection
132 Cylinder contour

133 Acceptance angle
134 Distance
135 Axis of symmetry
136 Axis of symmetry
137 Slide track
138 Angle
139 Counter plate
140 Leg
141 Base
142 Longitudinal end face
143 Slide track
144 Plate
145 Guide track
146 Slide block
147 Positioning surface
148 Drive system
149 Double arrow
150 Double arrow
151 Longitudinal scale bar
152 Compartment
153 Threaded spindle
154 Thread arrangement
155 Angle of inclination
156 Holder
157 Cutting element
158 Cutting element
159 Cross member
160 Drive system
161 Cross member
162 Track rod
163 Cutting edge
164 Cutting edge
165 Front end face
166 Reset
167 Angle of acceptance
168 End face surface
169 Apex
170 Boundary edge
171 Bearing surface
172 Fixing screw
173 Pivot axis
174 Mounting
175 Clamping plate
176 Clamping element
177 Clamping cylinder
178 Arrow
179 Thickness
180 Distance
181 Front edge
182 Diameter
183 Spray nozzle
184 Line
185 Spacing batten
186 Bottom face
187 Distance
188 End face
189 Thickness
190 Top face
191 Cut-away
192 Carriage system
193 End face
194 Projection
195 Base plate
196 Drive
197 Carriage system
198 Tool holder
199 Guide arrangement
200 Arrow
201 Bottom face
202 Top face
203 Arrow
204 Guide face
205 Bearing element
206 Height
207 Bearing
208 Mounting frame
209 Support frame
210 Guide housing
211 Guide device
212 Height
213 Height
220 Guide rods
221 Guide carriage
222 Cantilever
223 Piston rod
224 Actuating cylinder
225 Contour
226 Cartridge
227 Side arm
228 Side arm
229 Base arm
230 Head plate
231 Arrow
232 Clamping plate
233 Guide post
234 Guide element
235 Guide bush
236 Coil spring
237 Spring arrangement
238 Front edge
239 Clamping surface
240 Shaping block
241 Positioning pin

What is claimed is:

1. A method of forming a corner region bounded on three sides from a flat plate having side edges having longitudinal extensions, comprising the steps of (a) folding down the side edges of the flat plate by a predetermined height from the plane of the flat plate and across at least a major part of the longitudinal extensions to form side walls in the corner region in a three-dimensional curved transition region, (b) clamping the transition region between a tool having a predeterminable, three-dimensional external shape, of the corner to be formed and a height-adjustable clamping plate pressed against the flat plate, (1) the external shape of the tool being comprised of shaping surfaces having a height same as or slightly larger than a height of the side walls plus a height of an excess projection in the corner region and to be trimmed, the clamping plate having front edges cooperating with the shaping surfaces of the tool forming the corner region, (2) Positioning the front edges flush with the shaping surfaces of the tool or protecting therefrom by a distance slightly smaller than the thickness of the side walls, (c) shaping the transition region by means of at least one roller system overlapping the corner region between the side walls by pressing in the curved transition region against the tool.

2. The method of claim 1, wherein a distance between the shaping surfaces of the tool and a cylindrical contour of the roller system, and extending perpendicularly to the shaping surfaces is at most equal to the thickness of the side walls.

3. The method of claim 2, further comprising the step of adjusting the tool and the clamping plate to obtain the distance between the shaping surfaces of the tool and the cylindrical contour of the roller system.

4. The method of claim 2, further comprising the step of adjusting the cylindrical contour of the roller system to obtain the distance between the shaping surfaces of the tool and the cylindrical contour.

5. The method of claim 1, further comprising the steps of affixing the clamping plate to a safety door delimiting a working region, and adjusting the distance of the clamping plate with the safety door relative to the flat plate.

6. The method of claim 5, further comprising the step of applying the clamping plate against the tool by a clamping element actuatable independently of the adjusting of the distance of the clamping plate with the safety door relative to the flat plate whereby a compression force is exerted in the direction of the tool.

7. The method of claim 1, wherein the shaping surfaces of the tool intersect at tool corners, further comprising the step of providing a roller of the roller system at each tool corner.

8. The method of claim 1, further comprising the step of providing a respective one of the clamping plates at each tool corner.

9. A device for forming a corner region bounded on three sides from a flat plate having a top face and side walls folded down from side edges of the flat plate by a predetermined height and across at least a major part of the longitudinal extension, which comprises (a) a roller system, for forming the corner region in a three-dimensional shape, (b) a tool having a predeterminable, three-dimensional external shape, (1) the external shape of the tool being comprised of a top face and shaping surfaces having a height corresponding to the predetermined height of the side walls plus a height of an excess projection extending from the side walls and to be trimmed, and (c) a clamping device displaceable in a direction substantially perpendicular to the top face of the tool for clamping the flat plate to the top face of the tool, the clamping plate having front edges cooperating with the shaping surfaces of the tool forming the corner region, and (1) the front edges being flush with the shaping surfaces of the tool or projecting therefrom by a distance slightly smaller than the thickness of the side walls.

10. The device of claim 9, wherein the roller system comprises a roll rotatably mounted in a bearing fixed in a mounting frame, a support frame having guide elements for replaceably inserting a guide housing in a guide device, the guide housing being displaceable relative to the tool by means of a drive system, and a replacement device receiving the guide device, the replacement device having elements for clamping the support frame in a correct position in the guide housing.

11. The device of claim 9, further comprising shaping sections on the top face of the tool in different corners thereof, the shaping sections at the different corners having different dimensions.

12. The device of claim 9, wherein the roller system and the clamping device form a jointly displaceable shaping and clamping unit, further comprising a common drive for displacing the unit.

13. The device of claim 9, further comprising a cartridge housing the roller system and the clamping device and a guide carriage retaining the cartridge for rapid replacement of the cartridge.

14. The device of claim 13, wherein the clamping device comprises a clamping plate mounted on guide posts in the cartridge for displacement against the bias of a spring arrangement.

* * * * *